US007892053B2

(12) United States Patent
St-Pierre et al.

(10) Patent No.: US 7,892,053 B2
(45) Date of Patent: Feb. 22, 2011

(54) COMMONLY ACTUATED TRIM AND REVERSE SYSTEM FOR A JET PROPULSION WATERCRAFT

(75) Inventors: Luc St-Pierre, Grand-Mère (CA); Pierre Gaudet, Trois-Rivières (CA); Christian Laing, Grand-Mère (CA); Alexandre Leclerc, Trois-Rivières (CA); Louise Mailloux-Leclerc, legal representative, Trois-Rivières (CA)

(73) Assignee: Teleflex Megatech Inc., Grand-Mere (Quebec) (CA)

( * ) Notice: Subject to any disclaimer, the term of this patent is extended or adjusted under 35 U.S.C. 154(b) by 75 days.

(21) Appl. No.: 11/849,178

(22) Filed: Aug. 31, 2007 (Under 37 CFR 1.47)

(65) Prior Publication Data

US 2008/0182463 A1 Jul. 31, 2008

Related U.S. Application Data

(60) Provisional application No. 60/841,536, filed on Sep. 1, 2006, provisional application No. 60/897,518, filed on Jan. 26, 2007.

(51) Int. Cl.

| | |
|---|---|
| ***B63H 11/00*** | (2006.01) |
| ***B63H 11/10*** | (2006.01) |
| ***B63H 11/107*** | (2006.01) |
| ***B63H 11/11*** | (2006.01) |
| ***B63H 11/113*** | (2006.01) |

(52) U.S. Cl. ..... 440/40; 440/41; 440/42; 701/21

(58) Field of Classification Search ..... 440/1, 440/38, 40–43; 701/21

See application file for complete search history.

(56) References Cited

U.S. PATENT DOCUMENTS

| | | | | |
|---|---|---|---|---|
| 5,154,650 | A * | 10/1992 | Nakase | 440/41 |
| 5,507,672 | A | 4/1996 | Imaeda | |
| 5,752,864 | A | 5/1998 | Jones et al. | |
| 5,755,601 | A * | 5/1998 | Jones | 440/1 |
| 5,879,209 | A * | 3/1999 | Jones | 440/42 |
| 5,934,954 | A | 8/1999 | Schott et al. | |
| 6,045,418 | A | 4/2000 | Roos | |
| 6,113,443 | A | 9/2000 | Eichinger | |
| 6,267,633 | B1 | 7/2001 | Suganuma | |
| 6,305,307 | B1 | 10/2001 | Yokoya | |
| 6,350,163 | B1 | 2/2002 | Fujimoto | |
| 6,547,611 | B1 | 4/2003 | Boroos et al. | |
| 6,676,462 | B2 | 1/2004 | Yanagihara | |
| 6,729,918 | B2 | 5/2004 | Fuse et al. | |
| 6,875,065 | B2 | 4/2005 | Tsuchiya et al. | |
| 6,886,529 | B2 | 5/2005 | Suzuki et al. | |
| 6,905,378 | B2 | 6/2005 | Uraki et al. | |
| 6,905,381 | B2 | 6/2005 | Araki et al. | |
| 7,018,251 | B2 | 3/2006 | Iwakami et al. | |
| 7,166,003 | B2 | 1/2007 | Motose | |
| 7,195,527 | B2 | 3/2007 | Tani et al. | |
| 7,201,620 | B2 | 4/2007 | Kinoshita et al. | |

* cited by examiner

*Primary Examiner*—Ajay Vasudeva
(74) *Attorney, Agent, or Firm*—Baker & Hostetler LLP

(57) ABSTRACT

A commonly actuated trim and reverse system for a jet propulsion watercraft is provided. The system includes a movable actuator connected to a movement transfer mechanism. The movement transfer mechanism is operable to adjust both the trim angle of the steering nozzle of the watercraft and the orientation of the reverse gate, as a function of the movement of the actuator. Control electronics evaluate the target steering for the trim angle and gate orientation and control the movement of the actuator accordingly.

19 Claims, 21 Drawing Sheets

COMMONLY ACTUATED TRIM AND REVERSE SYSTEM FOR A JET PROPULSION WATERCRAFT

CROSS-REFERENCE TO RELATED APPLICATIONS

This application claims priority to U.S. provisional patent application Ser. No. 60/841,536, titled, "Electronically Assisted Trim and Reverse System for a Personal Watercraft," filed Sep. 1, 2006, now converted, and U.S. provisional patent application Ser. No. 60/897,518, titled, "Electronically Assisted Trim and Reverse System for Water Jet Propulsion Watercraft," filed Jan. 26, 2007, now converted, the disclosure of each which is hereby incorporated by reference in its entirety. This application is also related to U.S. patent application Ser. No. 11/849,202, titled, "Automatic Trim System for a Jet Propulsion Watercraft," filed Aug. 31, 2007, now published, concurrently herewith and U.S. patent application Ser. No. 11/849,189, titled, "Electronically Assisted Reverse Gate System for a Jet Propulsion Watercraft," filed Aug. 31, 2007, now published, concurrently herewith, the disclosure of each which is hereby incorporated by reference in its entirety.

FIELD OF THE INVENTION

The present invention relates to water jet propulsion vehicles such as personal watercraft and more particularly concerns the control of the vertical trim system and of the reverse gate of such a vehicle.

BACKGROUND OF THE INVENTION

Water jet propulsion vehicles, such as jet boats and personal watercraft, use a jet drive which creates a strong stream of water projected toward the rear of the vehicle through an impeller, therefore propelling the vehicle forward. A steering nozzle provided rearward of the impeller allows the craft operator to steer the vehicle by directing the nozzle left and right, changing the direction of the water stream and therefore the direction of the vehicle itself. Typically, the steering nozzle is also movable vertically to balance the ship. This vertical control is referred to as the VTS (Vertical Trim System).

Some water jet propulsion vehicles can also travel in the reverse direction through the provision of a reverse gate. The reverse gate is a loop which can be lowered over the steering nozzle, sending the water stream forward of the vehicle and therefore propelling it rearward. While this feature can be useful in some circumstances, on a traditional jet propulsion watercraft it is not designed to be used to slow down or stop the vehicle and it could in some instances be dangerous to use it for either one of these purposes, especially in the case of personal watercraft.

There is a need in the industry for an improved control of the stability of personal watercraft or the like. It would also be advantageous to provide such vehicles with new or improved functions such as braking or a neutral.

SUMMARY

Firstly, at least some of the drawbacks mentioned above are alleviated by commonly actuated trim and reverse system for a jet propulsion watercraft, the watercraft including a steering nozzle vertically pivotable so as to have a variable trim angle, said watercraft further including a reverse gate pivotable so as to have a variable gate orientation, said trim and reverse system comprising a movable actuator; a movement transfer mechanism connected to the actuator and operable to adjust the trim angle and gate orientation as a function of a movement of said actuator; and control electronics for evaluating target settings for the trim angle and gate orientation, said control electronics controlling the movement of the actuator based on said target settings.

There is also provided a jet propulsion watercraft, comprising a reverse gate pivotable in and out of a path of a water stream from said watercraft, said reverse gate thereby having a variable gate orientation; an operator interface for obtaining commands from an operator of the watercraft; control electronics in communication with the operator interface for receiving said commands therefrom, said control electronics evaluating target settings for the gate orientation in response to said commands, the target settings being evaluated based on at least one operating condition of said watercraft, the control electronics issuing control signals based on said target settings; and an actuating device operable to adjust the gate orientation in response to said control signals.

There is also provided a trim and reverse system for a jet propulsion watercraft, the watercraft including a steering nozzle vertically pivotable so as to have a variable trim angle, said watercraft further including a reverse gate pivotable so as to have a variable gate orientation, said trim and reverse system comprising a movable actuator operationally connected to the nozzle and the reverse gate so the trim angle and gate orientation are adjusted as a function of a movement of said actuator; and control electronics for evaluating target settings for the trim angle and gate orientation, said control electronics controlling the movement of the actuator based on said target settings.

Secondly, at least some of the drawbacks mentioned above are alleviated by an electronically assisted reverse gate system for a jet propulsion watercraft, the watercraft including a reverse gate pivotable in and out of a path of a water stream from said watercraft, said reverse gate thereby having a variable gate orientation, the watercraft further including an operator interface for obtaining commands from an operator of the watercraft, said reverse gate system comprising: control electronics in communication with the operator interface for receiving said commands therefrom, said control electronics evaluating target settings for the gate orientation in response to said commands, the target settings being evaluated based on at least one operating condition of said watercraft, the control electronics issuing control signals based on said target settings; and an actuating device operable to adjust the gate orientation in response to said control signals.

There is also provided a jet propulsion watercraft, comprising: a reverse gate pivotable in and out of a path of a water stream from said watercraft, said reverse gate thereby having a variable gate orientation; an operator interface for obtaining commands from an operator of the watercraft; control electronics in communication with the operator interface for receiving said commands therefrom, said control electronics evaluating target settings for the gate orientation in response to said commands, the target settings being evaluated based on at least one operating condition of said watercraft, the control electronics issuing control signals based on said target settings; and an actuating device operable to adjust the gate orientation in response to said control signals.

Thirdly, at least some of the drawbacks mentioned above are alleviated by an automatic trim system for a jet propulsion watercraft, the watercraft including a steering nozzle vertically pivotable between a fully trimmed up and fully trimmed down positions said steering nozzle defining a variable downward trim angle with respect to said fully trimmed up position, said watercraft further including a steering angle sensor for measuring a steering angle of the watercraft, said trim system comprising: control electronics in communication with the steering sensor for receiving said steering angle therefrom and monitoring said steering angle, said control electronics evaluating a target setting for the trim angle based on the steering angle, the control electronics automatically issuing control signals based on said target setting; and an actuating device operable to adjust the trim angle in response to said control signals.

There is also provided a jet propulsion watercraft, comprising: a steering nozzle vertically pivotable between a fully trimmed up and fully trimmed down positions said steering nozzle defining a variable downward trim angle with respect to said fully trimmed up position; a steering angle sensor for measuring a steering angle of the watercraft; and control electronics in communication with the steering sensor for receiving said steering angle therefrom and monitoring said steering angle, said control electronics evaluating a target setting for the trim angle based on the steering angle, the control electronics automatically issuing control signals based on said target setting; and an actuating device operable to adjust the trim angle in response to said control signals.

Advantageously, the embodiments described above provide for an improved stability of the watercraft and may make possible the use of the reverse gate for various functions such as braking functions, to slow down or stop the watercraft or to maintain it in a neutral position and provide an infinitely variable propulsion speed from absolute zero to the minimum speed achieved by forward or reverse thrust with engine at idle speed.

Other features and advantages will be better understood upon reading of preferred embodiments thereof with reference to the appended drawings.

DETAILED DESCRIPTION OF PREFERRED EMBODIMENTS

The present description generally relates to electronically assisted systems for controlling the vertical trim of a jet propulsion watercraft, the operation of the reverse gate for such a watercraft or both.

Figure 14A:
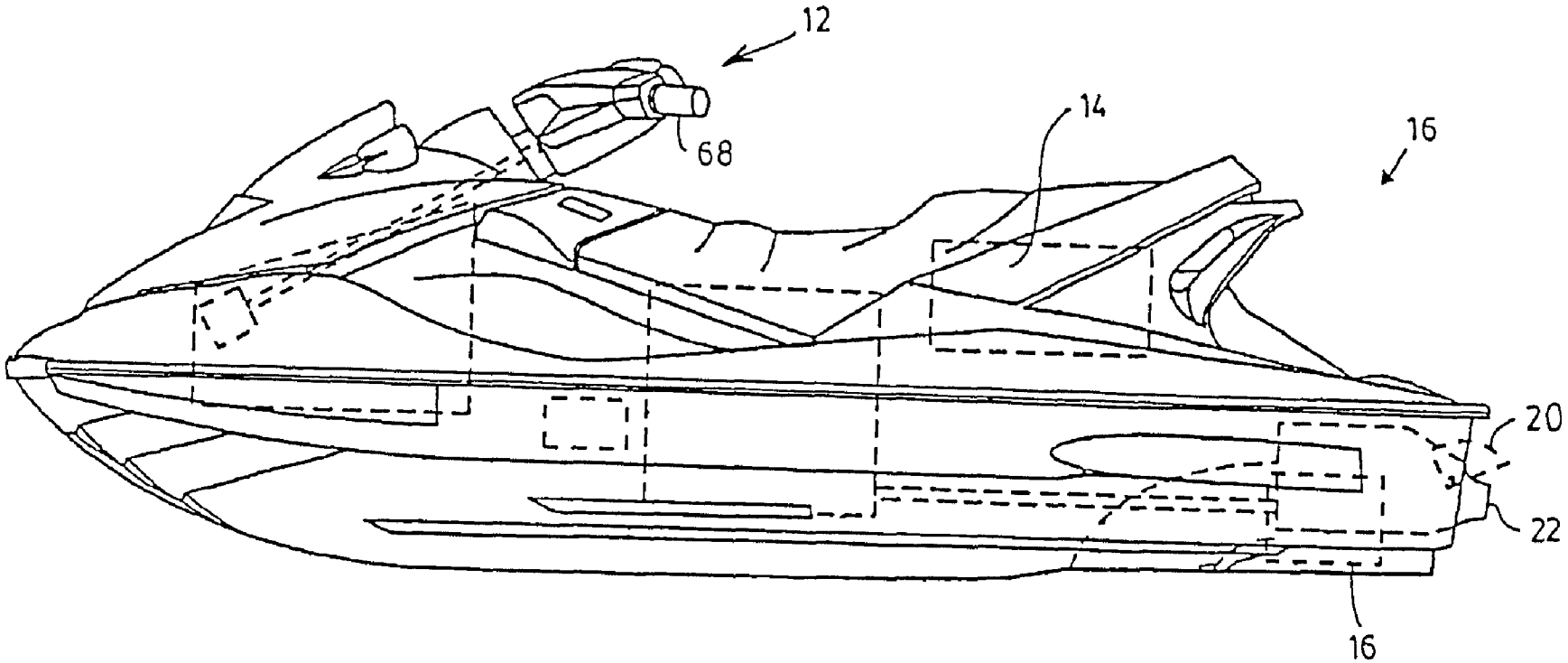
FIGS. 14A and 14B are respectively a side and a top view of a jet propulsion watercraft provided with at least on of the systems described herein.
Figure 14B:
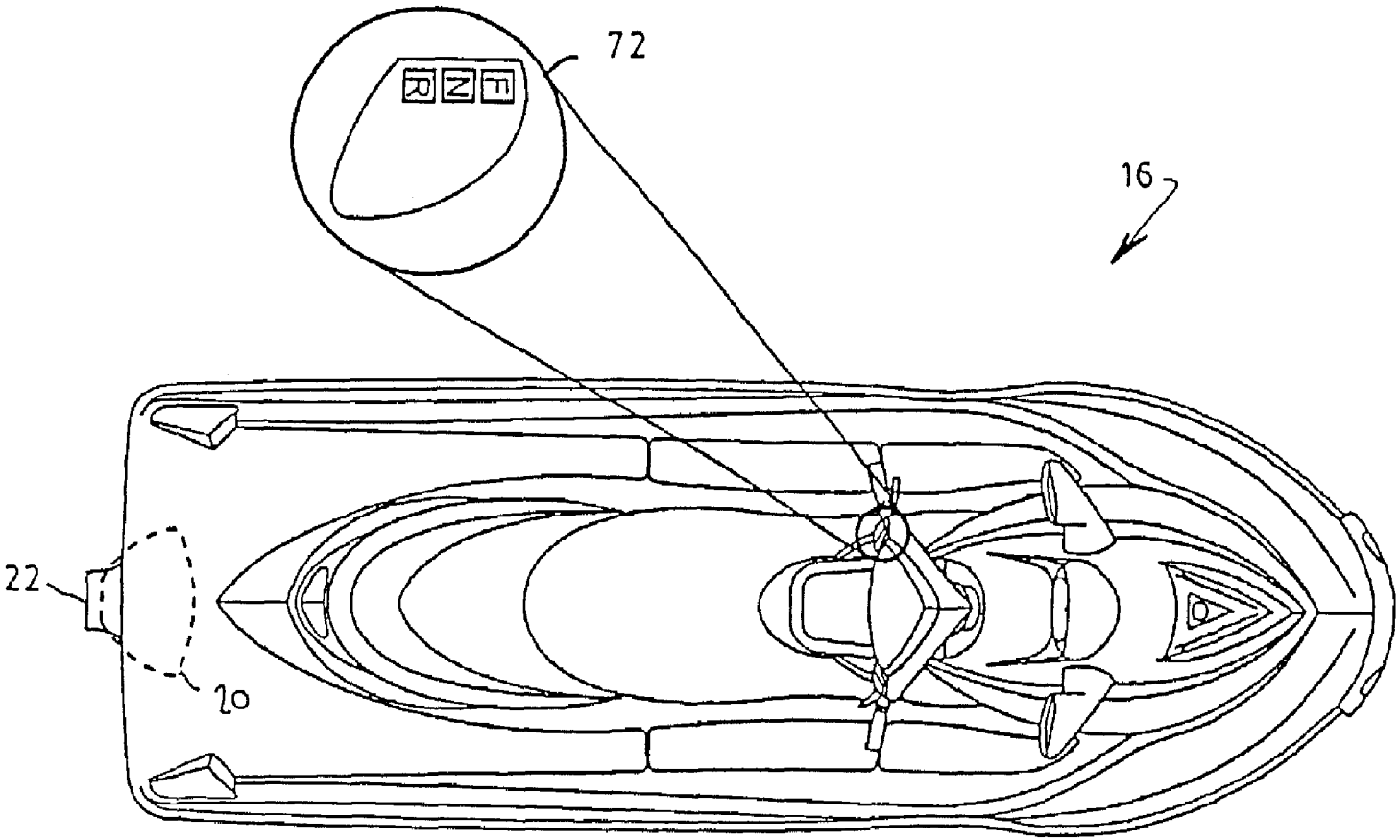

The systems described herein are intended for any watercraft propelled by a jet drive, such as a jet boat or a personal watercraft. As such, with reference to FIGS. 14A and 14B, the watercraft 16 includes an engine connected to an impeller creating a powerful stream of water projected rearward of the watercraft, which in reaction is propelled forward. A steering and trim nozzle 22 is provided rearward of the impeller, and is pivotable horizontally to steer the watercraft 16 left and right in response to a command from an operator driving the vehicle. For this purpose, the watercraft includes an operator interface 12 which receives commands from the operator. Typically, for a personal watercraft, the vehicles' handles are connected through cable linkage to the nozzle 22 so that, for example, turning the handle to the right will swivel the nozzle to the left, causing the watercraft to veer right. The nozzle 22 is also pivotable vertically to trim the watercraft, thereby defining a trim angle. The trim angle is understood herein to be a measure of the inclination of the steering nozzle 22 with respect to the horizontal axis of the watercraft. The watercraft further includes a reverse gate 20 defining a reversing loop for the water stream. The reverse gate 20 is pivotable in and out of the path of the water stream exiting the nozzle 22 of the watercraft, and therefore has an adjustable gate orientation. The expression "gate orientation" is understood herein to refer to the degree to which the reverse gate 20 is pivoted into the path of the water stream from the nozzle. In a preferred embodiment, the operator interface may also allow the operator to control the trim and/or the reverse system, as will be seen below.

Figure 1:
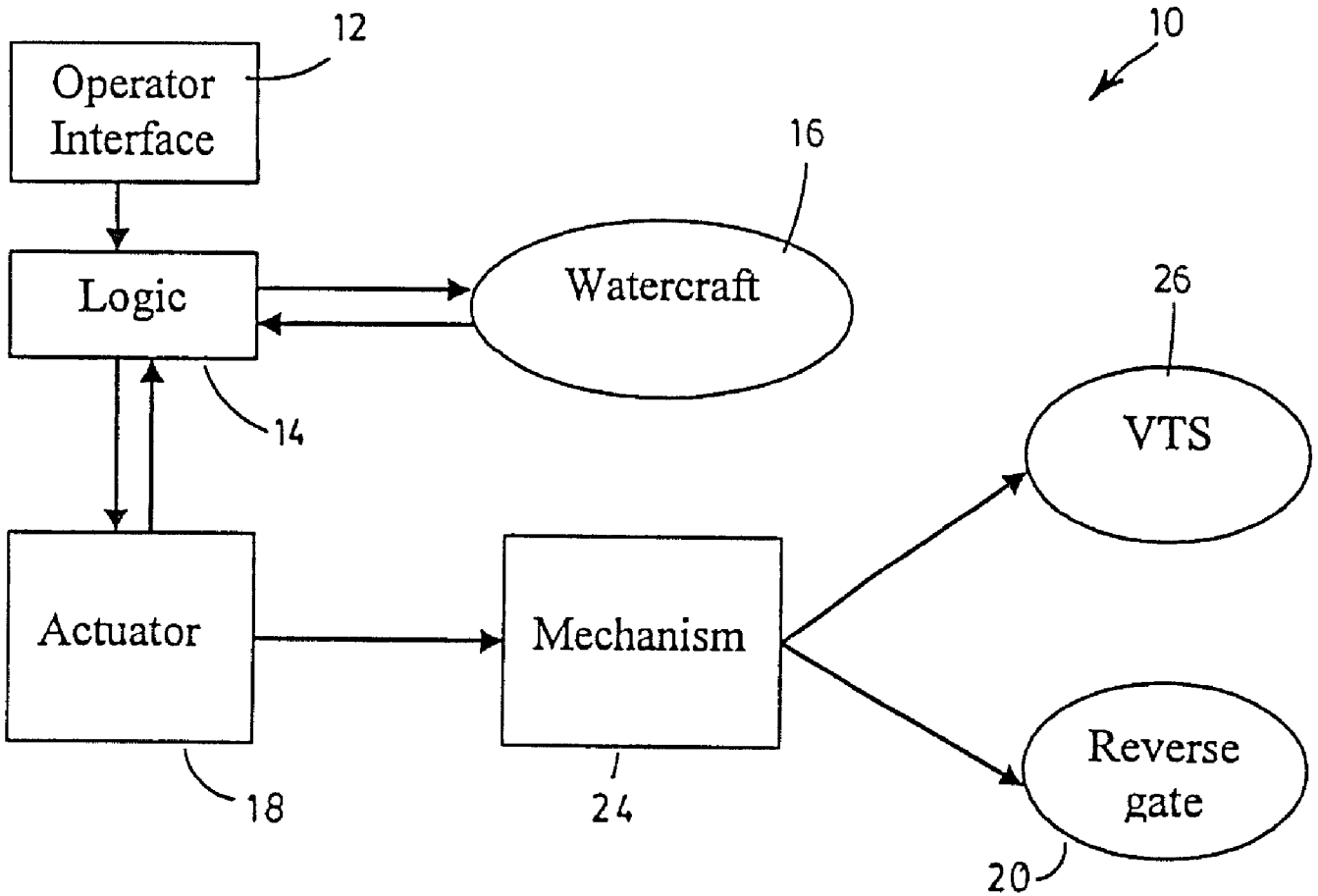
FIG. 1 is a functional diagram of an electronically controlled trim and reverse system according to one embodiment.

Referring to FIG. 1, there is shown a functional diagram of a trim and reverse system 10 for a jet propulsion watercraft.

The trim and reverse system 10 of FIG. 1 first includes control electronics 14 in communication with the operator interface 12 for receiving the commands therefrom. The commands from the operator may for example request a full forward, full reverse or neutral mode, a slow mode, a braking command, etc. The control electronics 14 may be in communication with operational components of the watercraft 16 to obtain the watercraft operating conditions. These operational components can for example include the engine providing its current rotational speed, a steering angle sensor providing the steering angle, a speed sensor providing the Speed-Over-Water or Speed-Over-Ground of the craft (SOW/SOG), a tilt sensor providing the forward/aft attitude, a throttle input. The control electronics 14 translates the command from the operator into control signals which preferably also take into consideration the watercraft operating conditions.

An actuator 18 is further provided and connected to the control electronics 14 to receive the control signals therefrom. In the embodiments described herein, a single actuator is used to control both the trim and reverse functions of the watercraft, but one skilled in the art will understand that two separate actuators could alternatively be used. The use of a single actuator advantageously simplifies the system and may involve less maintenance and repairs as it includes a lesser number of mechanical components. In the illustrated embodiment of the invention, the actuator 18 may for example be embodied by a translation rod linearly displaceable along a longitudinal course, or a rotational driving shaft.

The illustrated trim and reverse system 10 of FIG. 1 further includes a movement transfer mechanism 24 provided in connection to the actuator 18, reverse gate 20 and vertical control 26 of the nozzle (or "VTS"). The movement transfer mechanism 24 preferably includes an assembly of mechanical components which provides for the transfer of a linear or rotational displacement of the actuator 18 along into a predetermined movement sequence of the reverse gate 20 and of the vertical control 26 of the nozzle 22.

Various aspects of the trim and reverse system of FIG. 1 will now be described in more detail.

Commonly Actuated Trim and Reverse System

In accordance with one aspect of the system of FIG. 1, the trim angle of the nozzle and gate orientation of the reverse gate are controlled by a commonly actuated trim and reverse system. This system includes the movable actuator, and the movement transfer mechanism connected to the actuator. The movement transfer mechanism is operable to adjust the trim angle and gate orientation as a function of the movement of the actuator. The control electronics evaluate target settings for the trim angle and gate orientation, and controls the movement of the actuator based on these target settings.

Referring to FIGS. 2A, 2B and 6A through 6E, there is shown a preferred embodiment of the movement transfer mechanism 24. It will however be clearly understood by one skilled in the art that this particular mechanism is given by way of example and that numerous other assemblies and components could alternatively be used to obtain a similar result. In the description below, the designations "forward" and "rearward" are used with respect to the orientation of the watercraft, the forward direction being the normal direction of travel of the vehicle.

In the illustrated embodiment, the nozzle 22 is attached to the output of the impeller 40 through a bracket 38 which is pivotable vertically about a pivot axis defined by a horizontally extending screw 42. The reverse gate 20 is generally cup-shaped, has an upper arm 34 pivotally connected to the transfer mechanism as will be detailed below and a pair of lower arms 36 pivotally attached on either sides of the nozzle 22. The actuator 18 is a translation rod which moves along a generally longitudinal course. It will be understood that the actuator could deviate from the horizontal or have a different orientation.

The movement transfer mechanism 24 preferably includes a driving member connecting the actuator 18 and the reverse gate 20, for pivoting the reverse gate 20 when the actuator 18 moves. In the illustrated embodiment of FIGS. 2A and 2B, the driving member is embodied by a transfer plate 28 extending generally horizontally having a first end connected to the actuator 18 and a second end connected to the reverse gate, offset its pivot axis. In the illustrated embodiment, the actuator 18 includes a collar 50 attached to the front extremity 30 of the transfer plate 28 for connection to the actuator. The transfer plate 28 is therefore translated longitudinally, along a plane close to the horizontal, when the actuator 18 is displaced along its longitudinal course.

The movement mechanism further preferably includes a trim control lever 44 and a reverse gate control lever 46. Preferably, both levers 44 and 46 are pivotally mounted on a screw 42 and are therefore pivotable about the same pivot axis as the nozzle. It will be noted that the reverse gate lever 46 has a lever arm 48 on each side of the system 10, whereas the trim control lever 44 extends solely on the starboard side.

The reverse gate control lever 46 has an upper end 52 pivotally attached to the rear extremity 32 of the movement transfer plate 28. The upper end of the reverse gate control lever 46 is also provided with a support lever 54 attached to the upper arm 34 of the reverse gate 20. In this manner, when the movement transfer plate 28 is translated toward the rear of the craft under the action of the actuator 18, the upper end 52 of the reverse gate control lever 46 pivots rearward, and the upper arm 34 of the reverse gate 20 is both translated toward the rear and rotated downward. This movement therefore allows lowering the reverse gate in position to reverse the water stream from the nozzle 22.

The trim control lever 44 pivots under the joint action of a cam follower 56 attached to its upper end 57, and a guiding slot 60 provided in a side wall 58 of the movement transfer plate 28. In the illustrated embodiment, the cam follower 56 and guiding slot 60 are provided starboard of the watercraft, but they could of course be disposed elsewhere. The shape of the guiding slot 60 and its orientation with respect to the motion of the movement transfer plate 28 determine the moving pattern of the trim control lever 44, which in turn pivots the nozzle 22 accordingly. It will be understood that other guided arrangements relating the trim angle to the gate orientation could alternatively be provided.

With reference to FIGS. 2A and 3 to 5, there is illustrated a movement sequence of the embodiment of a commonly actuated trim and reverse system as described above. The movement sequence represents the manner in which the components of the system 10 move in order to both position the reverse gate and trim the nozzle as the actuator 18 is translated toward the rear of the watercraft. Of course, as will be readily understood by one skilled in the art, retracting the actuator toward the front of the craft will result in the opposite movement sequence of the components involved. It will also be understood that depending on the command given by the operator, the actuator may be moved along a portion of its longitudinal course only at a given time.

Figure 2A:
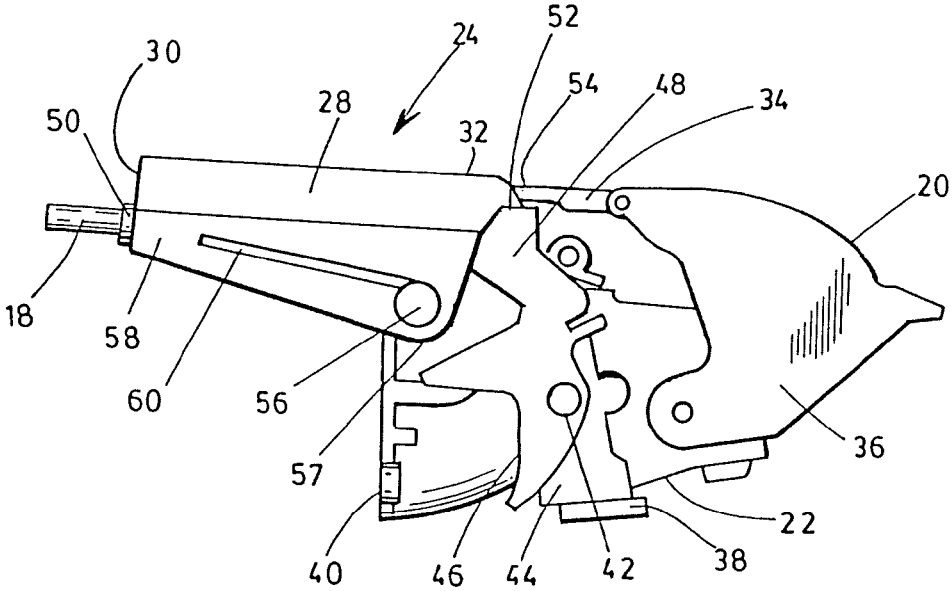
FIGS. 2A and 2B are respectively starboard and portside schematized views of a portion of a commonly actuated trim and reverse system according to one embodiment, with the actuator in a retracted position.
Figure 2B:
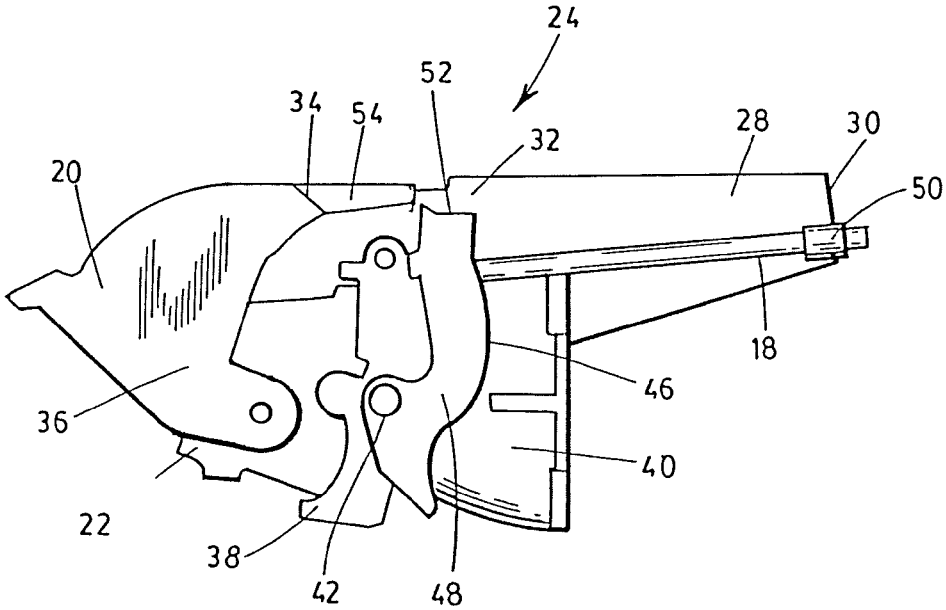

FIG. 2A shows the starting position of the movement sequence with the actuator 18 fully retracted toward the front of the watercraft. In this position, the nozzle 22 is in its uppermost trimming orientation and the reverse gate 20 is also in a retracted position.

Figure 3:
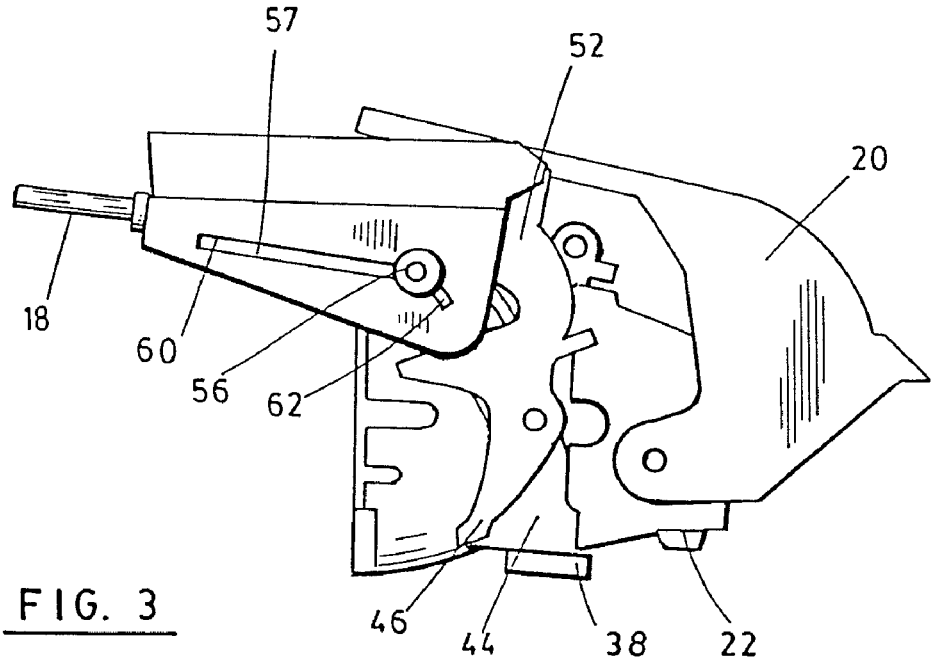
FIG. 3 is a starboard schematized view of the system of FIG. 2A with the actuator in a first extended position with the nozzle fully trimmed downward.

As the actuator 18 is translated rearward of the watercraft, the movement sequence first preferably includes a trim segment wherein the nozzle 22 pivots downwardly and the reverse 20 gate remains unobtrusive of the nozzle 22. In the illustrated embodiment, during this segment the cam follower 56 travels in the more acutely sloped portion 62 of the guiding slot 60, which has the effect of pivoting the upper end 57 of the trim control lever 44 toward the rear of the watercraft, which in turn pivots the bracket 38 and the nozzle downward. FIG. 3 shows the system at the end of this trim segment, with the nozzle in its lowermost trimming orientation.

During the trim segment, the upper end 52 of the reverse gate control lever 46 also begins to pivot toward the rear, and the reverse gate 20 starts to descend from its retracted position. This movement is however slow compared to the trimming of the nozzle 22, and at the end of the trim segment (see FIG. 3) the reverse gate 20 still remains unobtrusive of the nozzle 22.

Figure 4:
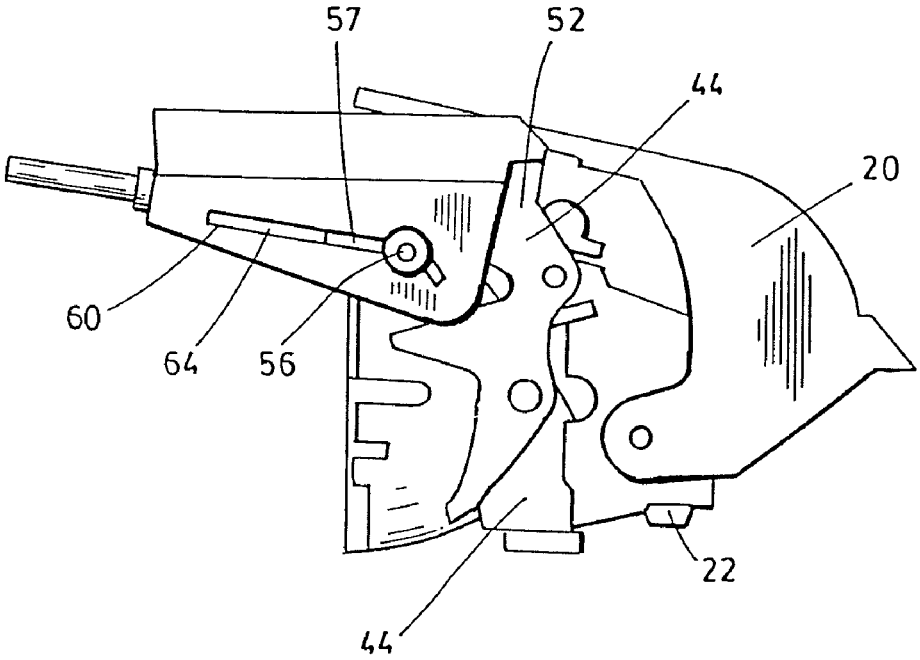
FIG. 4 is a starboard view of the system of FIG. 3 with the actuator in a second extended position with the nozzle moving upward and the reverse gate being partially lowered.
Figure 5:
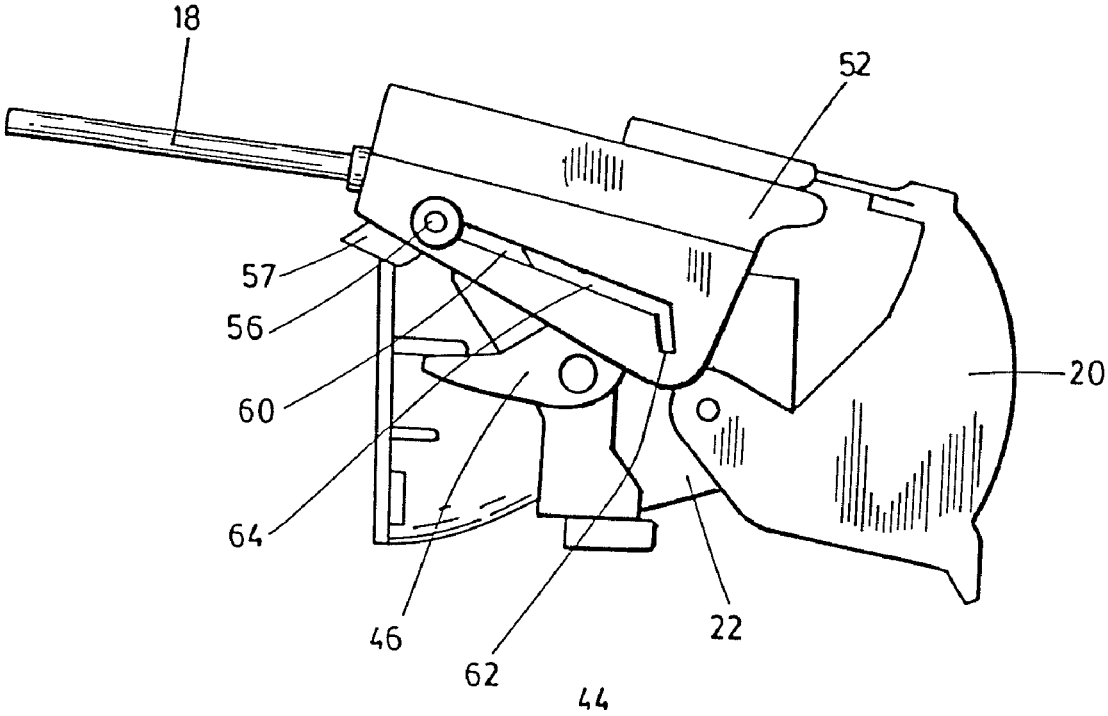
FIG. 5 is a starboard view of the system of FIG. 4 with the actuator in a fully extended position with the nozzle in a neutral vertical orientation and the reverse gate being fully lowered.
Figure 6A:
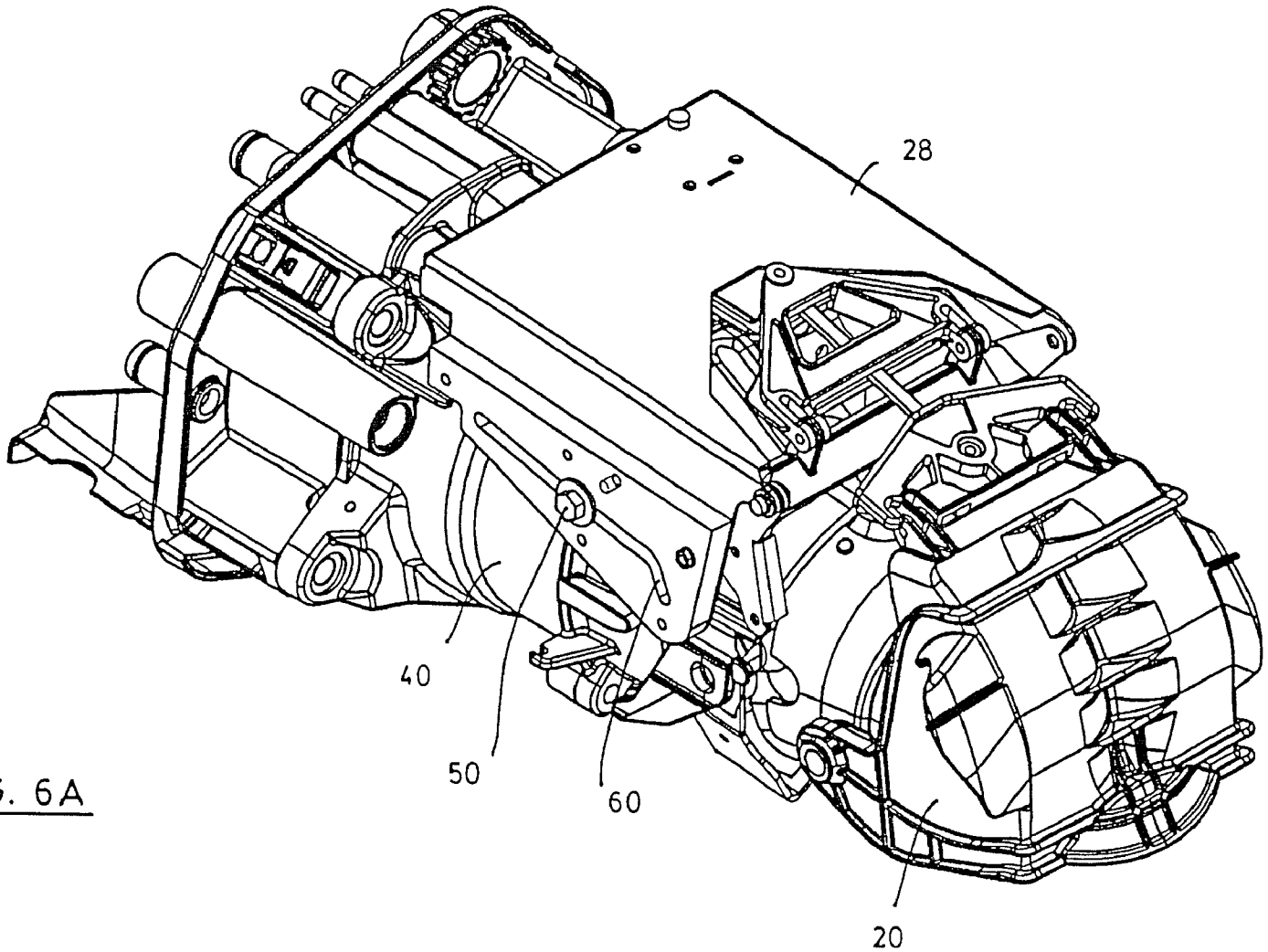
FIGS. 6A through 6E are more detailed representations of the system according to the embodiment of FIGS. 2A through 5 respectively showing a perspective view (FIG. 6A); a top view (FIG. 6B); a starboard view (FIG. 6C); a portside view (FIG. 6D); and a rear view (FIG. 6E).
Figure 6B:
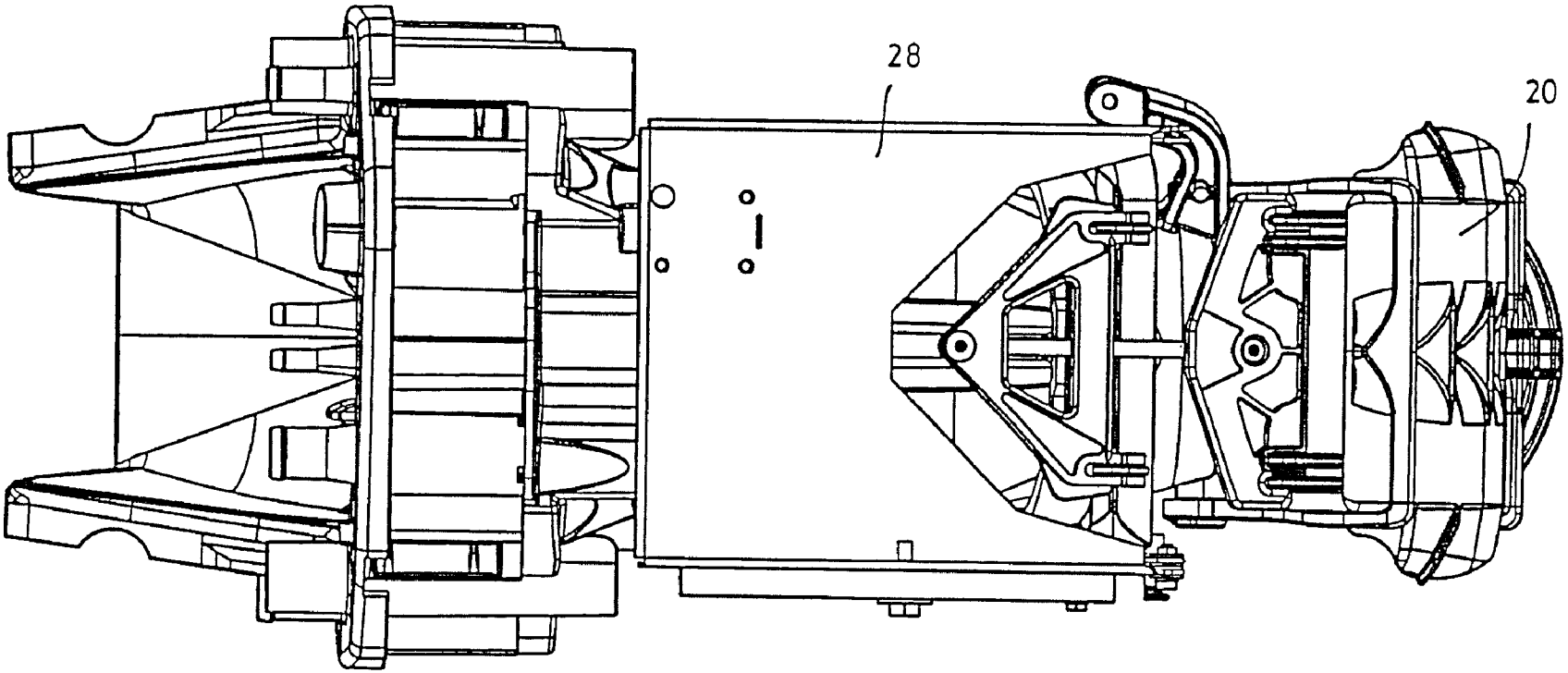
Figure 6C:
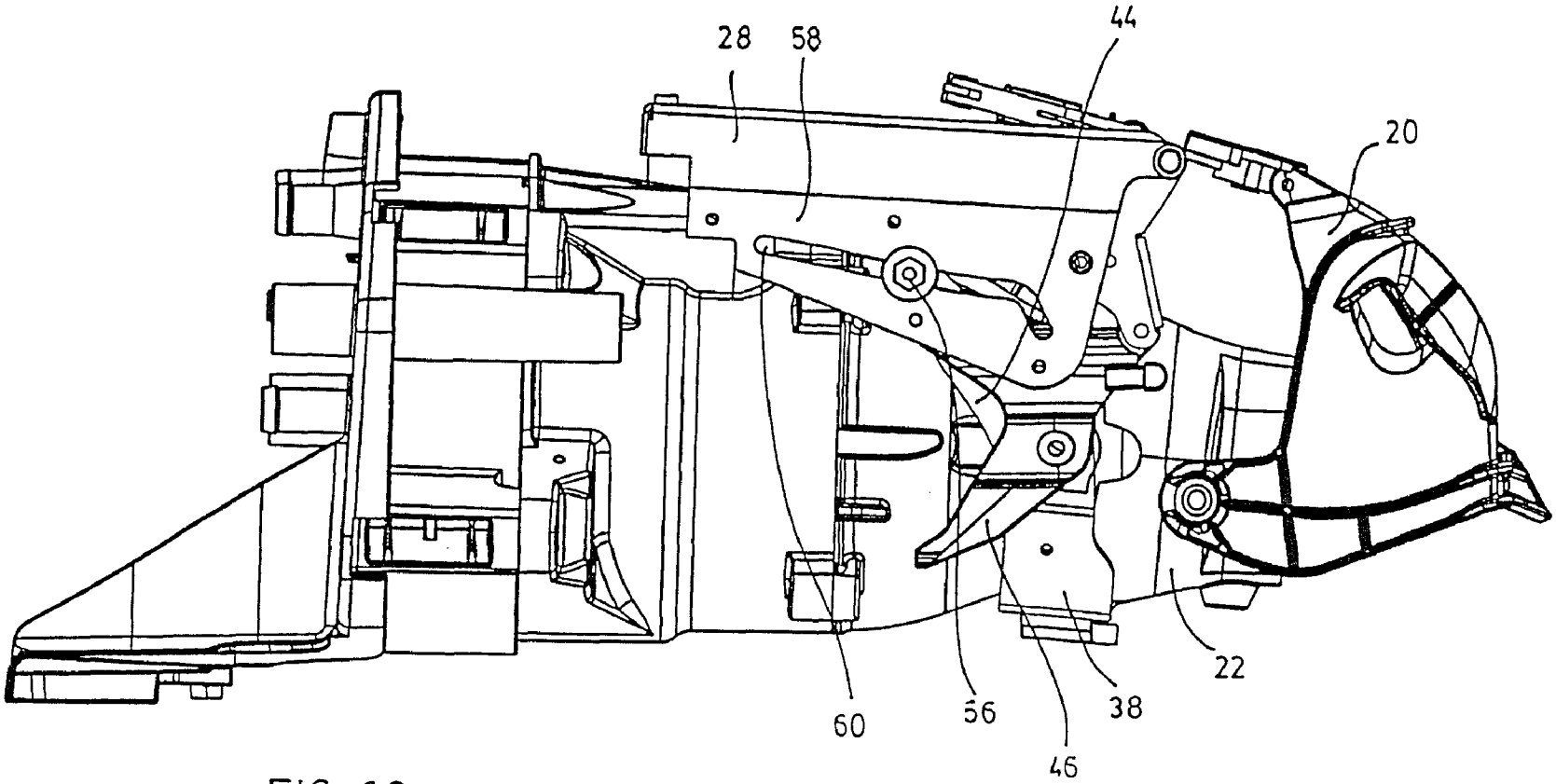
Figure 6D:
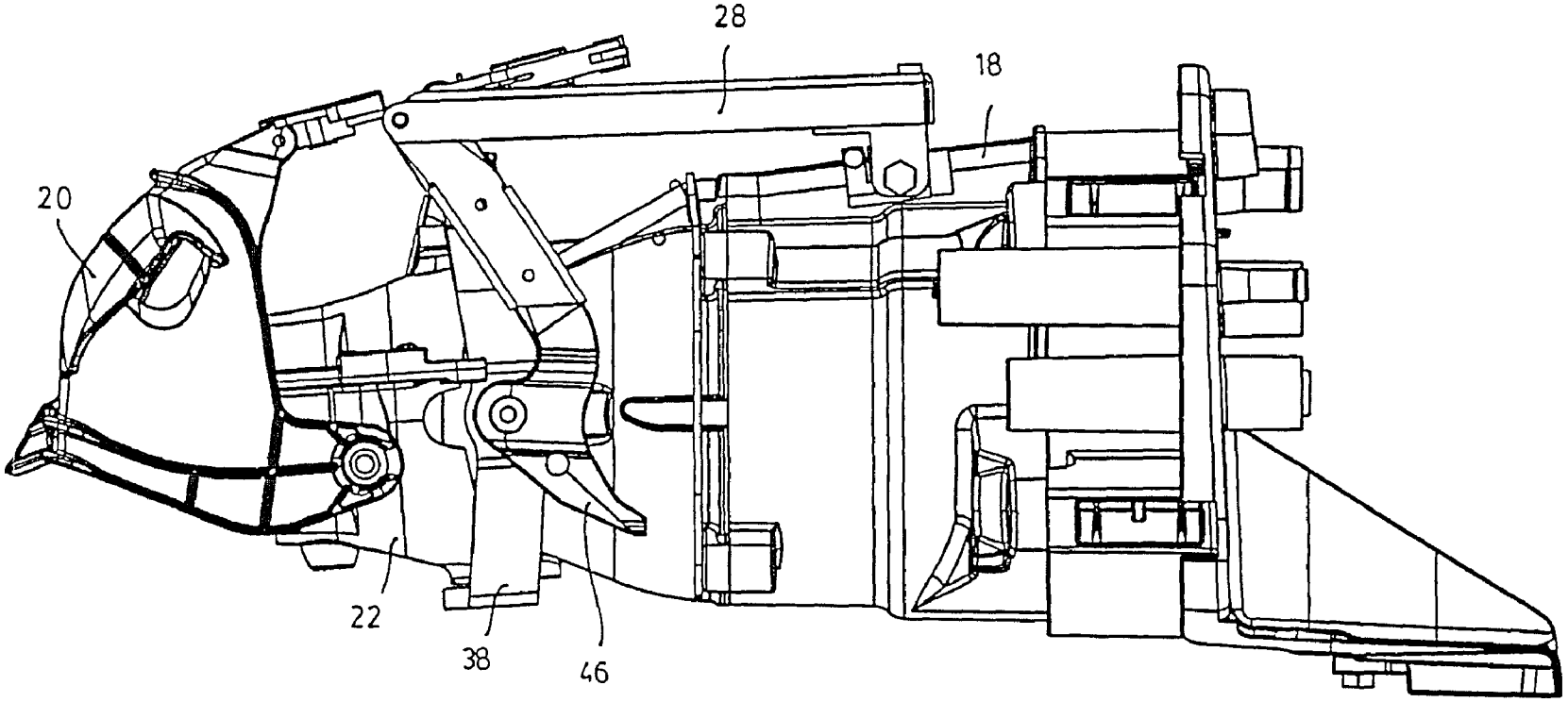
Figure 6E:
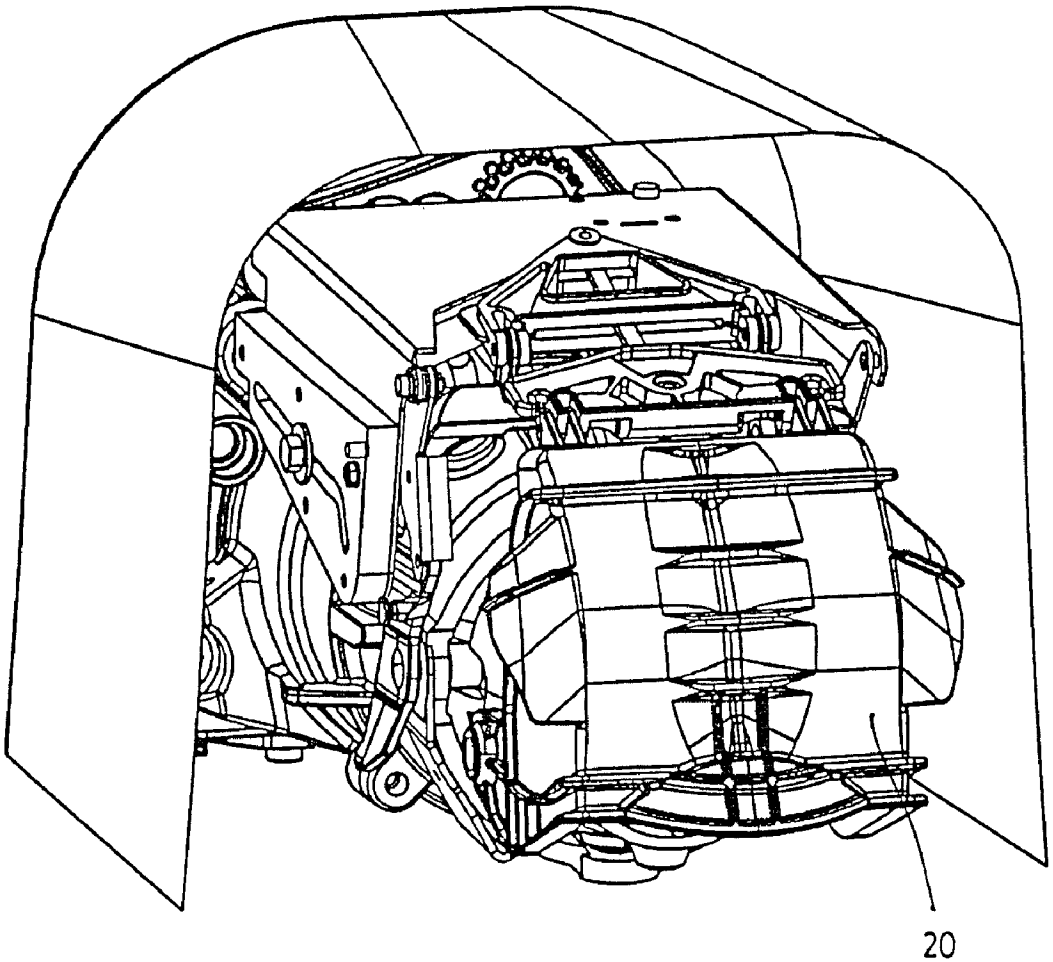

The movement sequence then includes an obstructing segment wherein the reverse gate 20 is pivoted in the path of the water stream and the nozzle 22 is pivoted to an optimal reverse vertical orientation. The beginning of this segment is shown in FIG. 4, and its end is shown in FIG. 5. it will of course be understood that the reverse gate can be set to any intermediate position inbetween, for example to provide a neutral mode or to control the speed in a slow mode.

During this segment, the cam follower 56 travels along the less sloped portion 64 of the guiding slot 60, which has the effect of first maintaining the upper end 57 of the trim control lever 44 in a fixed orientation and then slowly pushing it back toward the front of the watercraft, slowly pivoting the nozzle upward. At the end of this segment, as shown in FIG. 5, the nozzle 22 is at its optimal vertical position for reverse operation of the watercraft, that is, it extends generally horizontally.

At the same time, the upper end 52 of the reverse gate control lever 46 continues to pivot toward the rear, and the reverse gate 20 pivots in place directly behind the nozzle 22. As it is lower, an increasing portion of the water stream from the nozzle is redirected forward. At the end of the obstructing segment (see FIG. 5), the reverse gate 20 is therefore positioned to reverse the direction of travel of the watercraft by redirecting a maximum portion water stream in the forward direction.

Figure 7A:
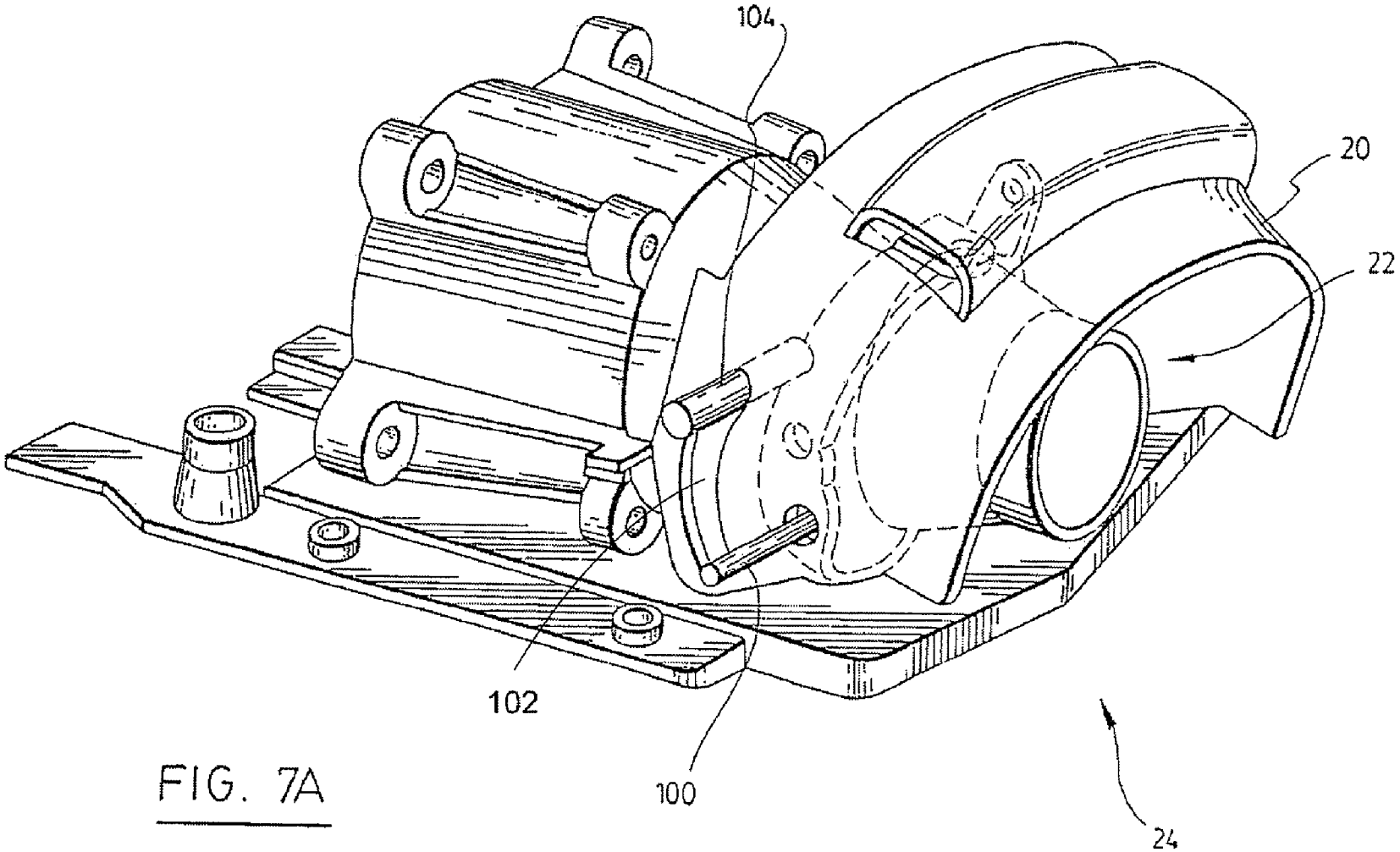
FIGS. 7A and 7B, is a schematized perspective view of a portion of a commonly actuated trim and reverse system according to another embodiment, respectively showing the reverse gate fully raised and fully lowered.
Figure 7B:
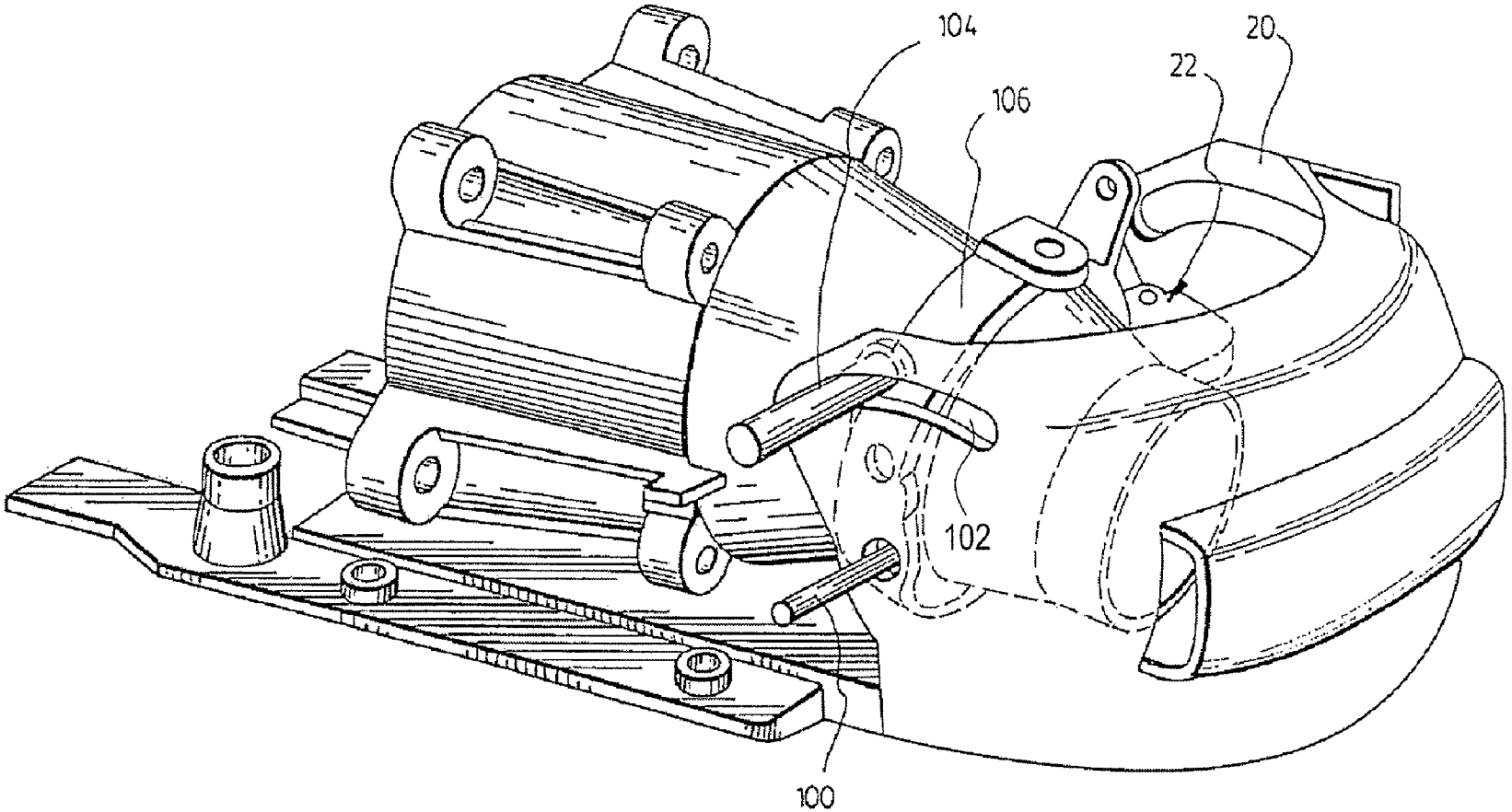
Figure 8:
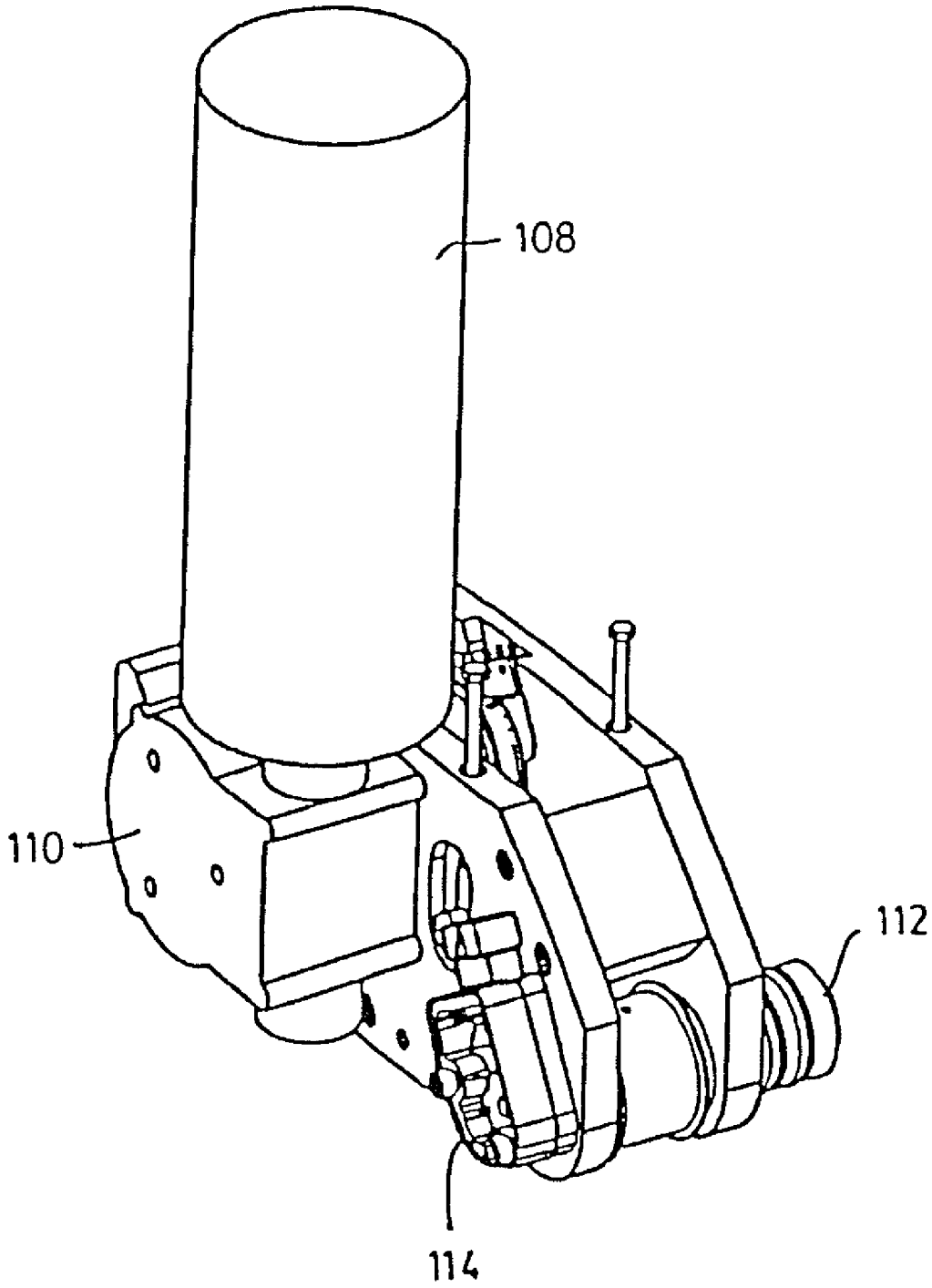
FIG. 8 is a perspective view of an actuator apt to cooperate with the system of FIGS. 7A and 7B.
Figure 9:
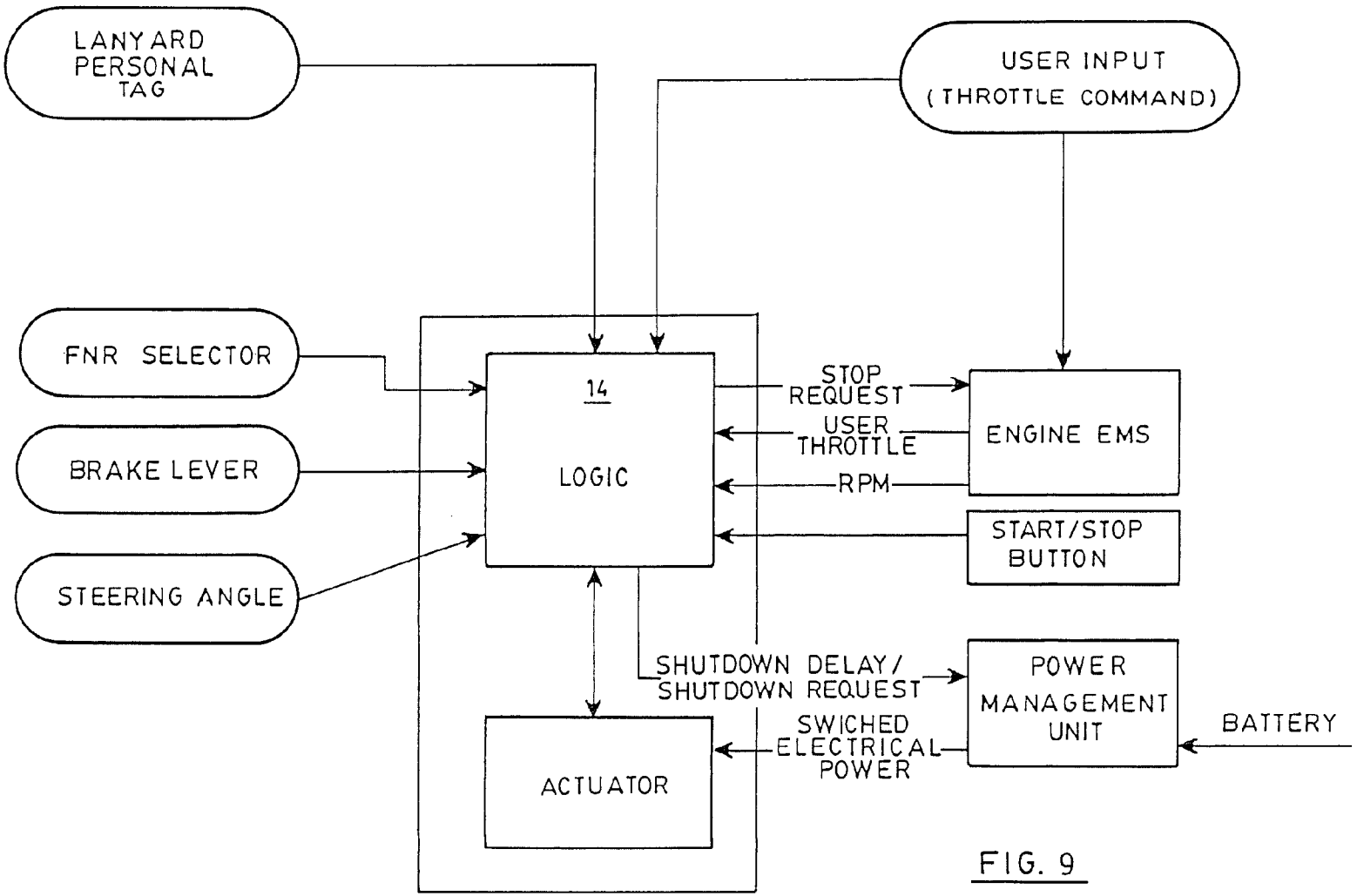
FIG. 9 is a functional diagram illustrating an electronically assisted reverse gate system according to an embodiment providing forward, reverse and neutral setting.

Referring to FIGS. 7A, 7B and 8, there is shown another embodiment of a movement transfer mechanism 24. In this case, the driving member is embodied by a rotatable driving shaft 100 operatively connected to the reverse gate 20, so that rotating the driving shaft 100 directly pivots the reverse gate 20. The driving shaft 100 preferably extends along the pivot axis of the reverse gate 20. The guiding arrangement relating the trim angle to the gate orientation in this case is embodied by a guiding slot 102 provided in the reverse gate 20. In the illustrated embodiment, a pair of guiding slots 102 is provided, one on each side of the reverse gate 20. A cam follower, such as a secondary shaft 104, cooperates with the guiding slot or slots 102. In a manner similar that the guiding arrangement of the previous embodiment. The secondary shaft 104 is operationally connected to the pivoting of the nozzle 22. In the embodiment of FIGS. 7A and 7B, the secondary shaft projects from either side of a bracket 106 surrounding the nozzle 22 and pivoting therewith.

FIG. 8 shows an example of an actuator 28 appropriate for driving the movement transfer mechanism of FIGS. 7A and 7B. The actuator 28 in this embodiment includes an electric motor 108, a gearbox 110 and a coupling 112 rotatable for transmitting a rotational movement to the driving shaft. An angular position sensor 114 is also provided for sensing the angular position of the coupling 112.

An advantage of this later embodiment is that the actuator can be positioned on the side of the nozzle.

Of course, the actuator and movement transfer mechanism may be embodied by any other appropriate combination of elements. Any relevant component not mentioned above could be added to those described. The actuator and control electronics could also be integrated one to the other, in the interest of saving space and facilitating the communication therebetween.

Electronically Assisted Reverse Gate System

In accordance with another aspect of the system of FIG. 1, an advantageous electronically assisted system is provided for controlling the reverse gale. In this system the control electronics evaluates target settings for the gate orientation in response to commands from the operator interface, and additionally takes into consideration one or more operating conditions of the vehicle in this evaluation. The control electronics then issue control signals to an appropriate actuating device to adjust the gate orientation. The actuating device could be according to one of the embodiments described above, but is not limited thereto. It is to be noted that for this aspect of the system of FIG. 1 the actuation of the trim and of the reverse gate could be separate, or the trim need not be adjustable at all.

The operating conditions could for example be the engine rotational speed, the throttle input, level of a braking commande, the steering angle of the watercraft, the forward or aft attitude of the watercraft, the speed over water or speed over ground of the watercraft, or any appropriate combinations thereof.

Such as electronically assisted reverse gate system opens up or improves on a variety of functions which are not readily available on prior art jet propulsion watercraft. Examples of such functions are given in the sections below.

a. Forward-Neutral-Reverse Selector

The electronic control of the reverse gate could be used to provide different operating modes for the watercraft. In this respect, the target settings for the reverse gate may include full forward and full reverse settings wherein the reverse gate is in a position out or into the path of the water stream, respectively. A neutral setting wherein the reverse gate is set to an intermediate position can optionally be provided. The intermediate position of the neutral setting can be calibrated from the factory and adjusted later on by a dealer or owner of the watercraft. The Intermediate position can also optionally be compensated along one of the engine rotational speed (RPM), trim angle or watercraft attitude, or combinations thereof.

A F-N-R button can be provided on the operator interface to select from the different directional modes instead of a mechanical cable pushed or pulled by a lever. Many marine engines take into account the engine RPM to inhibit shifting or reduce engine power for a given time to provide a softer shifting on the power train. The present system has the capability to take into account engine RPM, boat speed and throttle input to inhibit shifting or provide a progressive shifting and/or request engine torque reduction depending on conditions to avoid damaging the propulsion system or dismounting the operator.

The control electronics may also monitor one or more operating conditions of the watercraft, compare them to predetermined criteria, and automatically set the reverse gate to the neutral setting if these predetermined criteria are met. The predetermined criteria may be a threshold value for the engine rotational speed, the speed of the watercraft, throttle input, brake input and an operator overboard detection. In this manner, an automatic neutral function is provided.

For example such an automatic neutral mode could be used to prevent unwanted or sudden movement of the watercraft while starting the engine or afterwards. The can then set the reverse gate to the neutral setting as explained above. The automatic neutral could also be used during or after an engine shutdown/or during an engine cranking. When an engine start/stop situation is detected, for example when the lanyard is removed or the engine stalls, or when the user requests it, the control electronics may elect to keep the actuator powered for a period of time sufficient to allow the reverse gate to go to the neutral setting. The shutdown of the electrical system may then be confirmed once the watercraft is in the neutral mode. Automatic neutral could be engaged at low vehicle speed when throttle input is below a threshold and inversely automatic neutral would be inhibited at higher speed to provide better re-acceleration.

b. "Slow" Mode

In a typical personal watercraft, setting the propeller in a fixed pitch selected for optimizing an overall vessel performance and idle speed, and raising the reverse gate away from the path of the water stream, will result in a fixed forward thrust. In some instances that thrust can generate a faster forward speed than wanted by the operator, forcing him to cycle the throttle between the "Forward" and "Neutral" settings to achieve a lower speed.

When operating in reverse, with the reverse gate lowered in the path of the water stream, the same idle speed water thrust out of the nozzle will not create the same longitudinal speed than in the Forward setting, forcing the operator to use additional throttle in reverse mode and release the throttle in the forward mode to achieve the same acceleration/deceleration rates. During docking manoeuvres the different throttle settings required can be confusing and lead to dangerous situations.

Some of these problems can be alleviated by providing a "slow" mode. The target settings may include a variable position responsive to a slow mode command from the operator. The control electronics evaluates this variable position based on the operator's selection between the forward and reverse directions, and on the throttle input value.

Figure 10A:
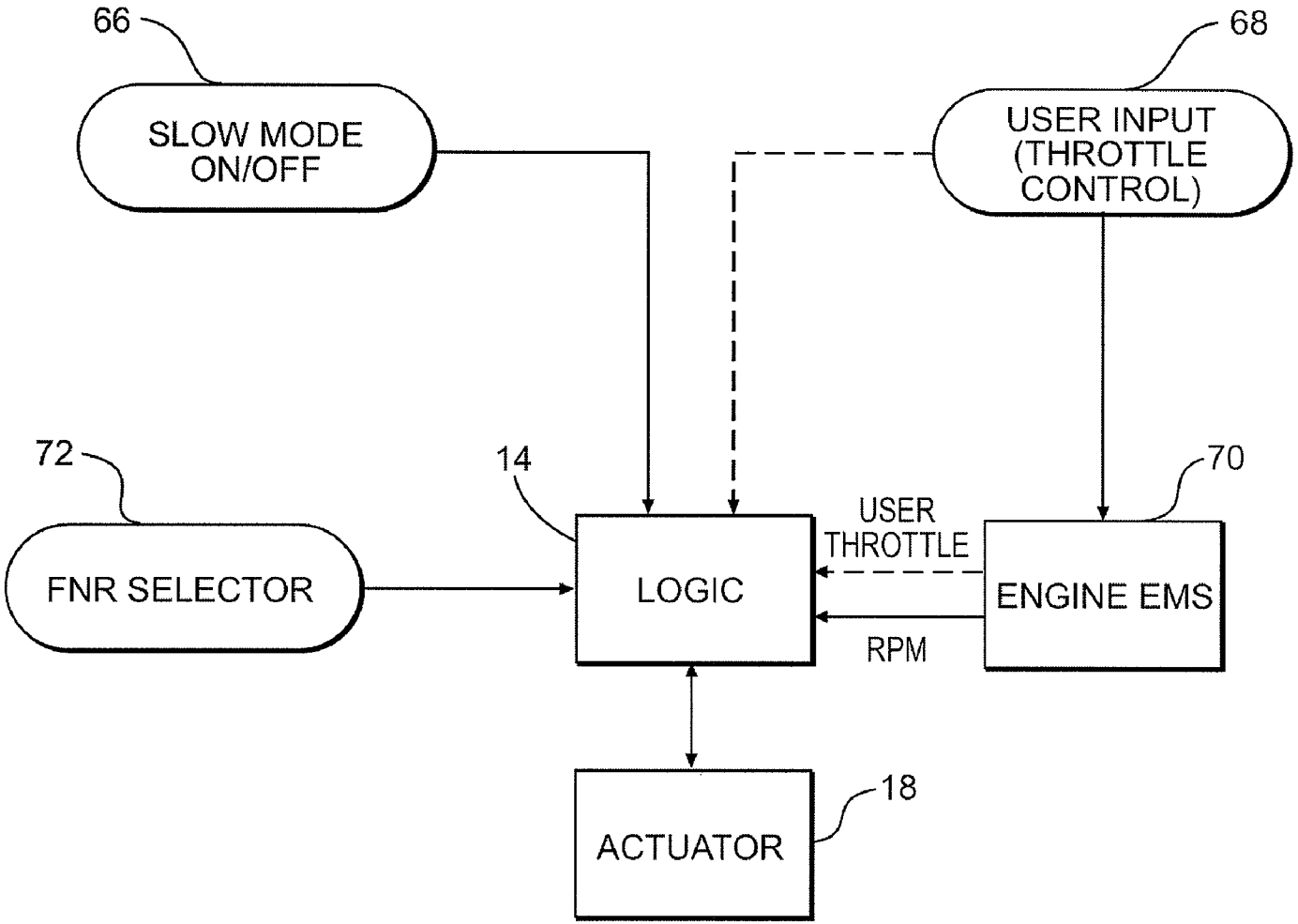
FIGS. 10A and 10B are functional diagram illustrating electronically assisted reverse gate systems according to embodiments providing a "slow" mode.

Referring to FIG. 10A, there is shown a functional diagram illustrating a preferred embodiment of such as slow mode. In this embodiment, the operator interface includes a control 66 allowing the switch a "slow" mode ON and OFF. Of course, any other type of control could be alternatively used. The operator interface also includes the throttle control 68 through which the operator controls the rotational speed of the engine 70. The FNR selector 72 also informs the control electronics if the watercraft is in forward, reverse or neutral mode.

When the slow mode is activated, the control electronics controls the actuator 14 to set the reverse gate in an intermediate lowered position, diverting only a portion of the water stream from the nozzle forward. In this manner, the resulting speed of the watercraft is less than it would be if the reverse gate was fully raised. Preferably, the control electronics takes into account the user throttle and the rotational speed of the engine 70 and controls the position of the reverse gate so that a given RPM value of the engine correspond to a predetermined speed.

When the watercraft is set in reverse and the slow mode is active, the control electronics sets the reverse gate in a position slightly higher than in full reverse mode, the reverse gate therefore diverting a larger portion of the nozzle's thrust in forward to provide a reverse speed similar to the forward speed at a given engine RPM value.

Preferably, if the operator changes the throttle input through the throttle control 68 the control electronics 14 can adjust the reverse gate to divert more or less flow forward, increasing or decreasing the velocity of the watercraft either in forward or reverse operation. Scaling of throttle input may be mapped to provide an expanded speed/thrust resolution over standard. The scaled mapping of the throttle input value to the desired speed could for example be as followed: a 0% throttle input could correspond to a 10% direct flow, whereas a 50% throttle input could correspond to a 30% direct flow.

Optionally, a full throttle application could be interpreted as an emergency situation requiring a maximum thrust, which could automatically disable the "slow mode" and provide the nozzle with a fully engaged or disengaged reverse gate As a safety feature, an Automatic slow mode may also be provided, for example to automatically bring the throttle back to slow mode when the throttle is Inactivated for more than a predetermined number of seconds, or when the brake is applied. For example, in this mode 50% of the throttle input could be used to provide only 10% of throttle output, so that the 50% position represent just 10% throttle. Passing that 50% value, throttle may go back to normal via a time related or position related function. In operating mode, if the operator release the throttle for the predetermined number of seconds or applies the brake, an algorithm can control the change in throttle behaviour, preventing unwanted acceleration. This feature may advantageously be coupled with a driver identification device or system to implement a learning mode or valet mode.

Alternatively, in conjunction with a proper throttle input in the EMS, this system could provide a variable flow control over a certain portion of the throttle input with the engine at idle or low speed, while the rest of the throttle input range could provide a fully unobstructed nozzle with full engine RPM modulation capability. For example: at 0-25% throttle input the engine could be forced by the control electronics to idle while the gate orientation is modulated in the slow range, between neutral and forward. 25%-100% throttle input would set the gate in the full forward position while the engine speed can be modulated from idle to the redline.

Figure 10B:
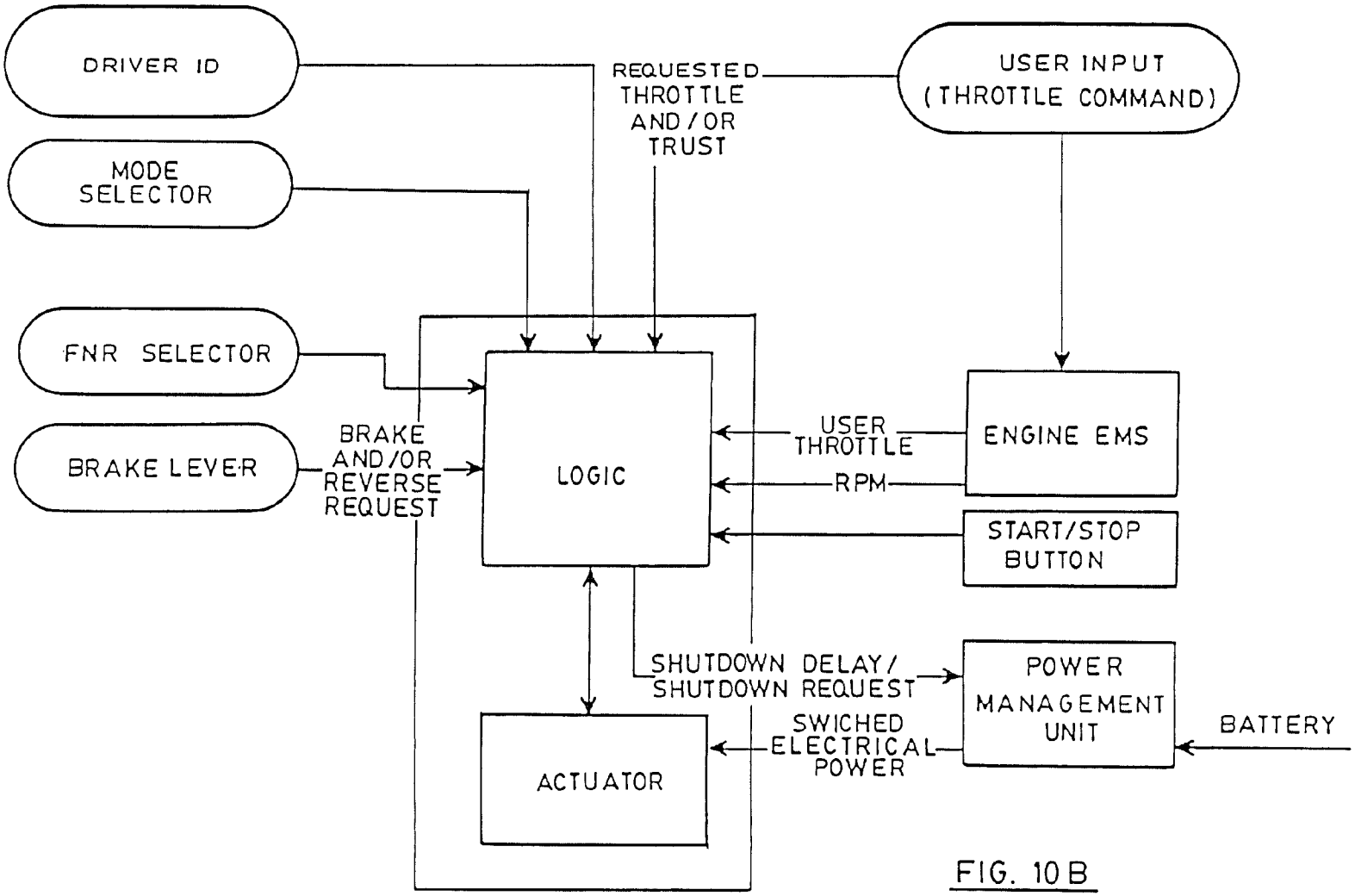

An example of a slow FNR Brake function diagram is shown in FIG. 10B.

c. Braking Mode

Depending on its speed, a watercraft can either in planing mode, where the craft rises partly over the water, or in water displacement mode where a significant portion of the craft's hull is submerged.

The deceleration characteristics of a watercraft vary greatly depending on its speed. For example, in water displacement mode, if the throttle is feathered or cut deceleration is mild, as only water friction on the hull and will act as a stopping force on the watercraft. Furthermore, the weight of displaced water gives the vessel a relatively high inertia to fight in order to slow it down or stop it.

In planing mode the contact area of the watercraft with water is greatly reduced, reducing drag and friction effects, and water displacement is significantly smaller. If the throttle is feathered or cut, the hull will transition more or less quickly from planing to water displacement mode, depending on various factors such as the geometry of the hull, the operational conditions of the watercraft and water conditions. This transition can generate significant deceleration rates over a short period of time.

It is generally considered highly unadvisable, unless for highly skilled operators, to lower the reverse gate behind the nozzle for braking purposes. Some engine and pump operating conditions can put a serious load on the reverse gate, as well as on the movement transfer mechanism and actuator. This is for example the case when the watercraft is in high pump thrust and the reverse gate is moved in or out of the path of the water stream. The accidental operation of the reverse gate in conditions where deceleration rates are already significant could also be dangerous. Even under normal reverse operation some engine load conditions could put undue stress and even damage the reverse gate and associated components. Finally, applying a reverse thrust when the nozzle is turned to one side can have the effect of moving the stern of the vessel in the same direction as the nozzle, which ultimately leads to the watercraft veering in the direction opposite to that of the steering command, which of course can be hazardous.

Figure 11:
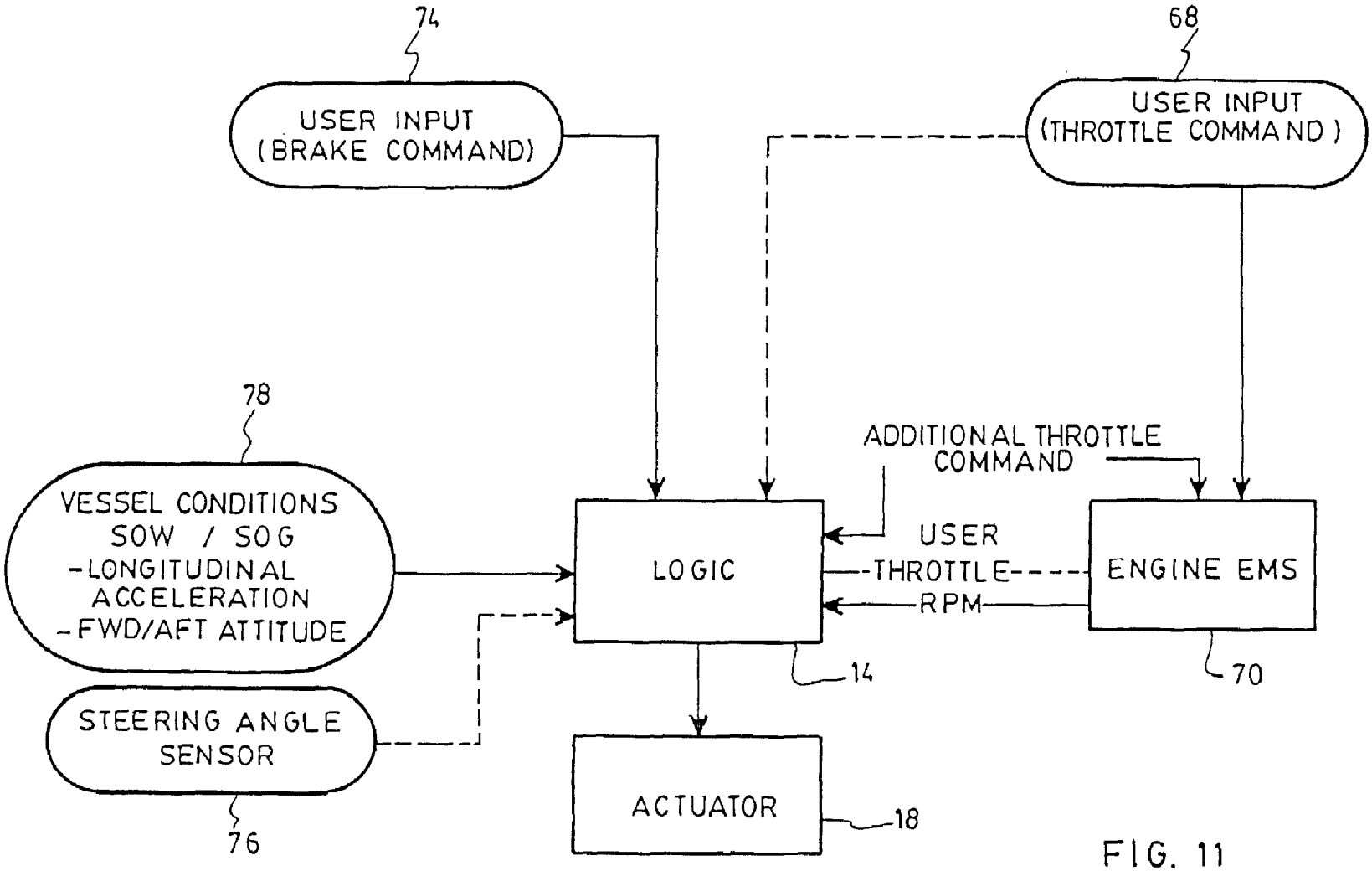
FIG. 11 is a functional diagram illustrating an electronically assisted reverse gate system according to an embodiment providing a braking function.

The system of the present invention however allows the use of the reverse gate for braking the watercraft by taking into consideration the operating conditions of the watercraft and making use of the reverse gate only under safe circumstances. The target setting could therefore include a braking position responsive to a braking command from the operator, the control electronics using the operating conditions to determine whether the reverse gate should be set to this braking position and automatically request additional engine torque as required. The system can also consider the steering angle to limit or inhibit the engine torque request to avoid a rotation of the craft around its axis that could affect its trajectory Referring to FIG. 11, there is shown a functional diagram of a system according to a preferred embodiment of the present invention used in braking mode. In the illustrated system the operator interface includes a brake control 74 which can be embodied by a lever, switch, button or other appropriate means. A braking command from the user is transferred to the control electronics 14. The control electronics processes this command in view of the operating conditions of the watercraft, taking into consideration the engine's RPM from the engine 70, the user throttle from the throttle control 68, the steering angle from the steering angle sensor 76, and various vessel conditions from sensing devices 78.

Figure 12:
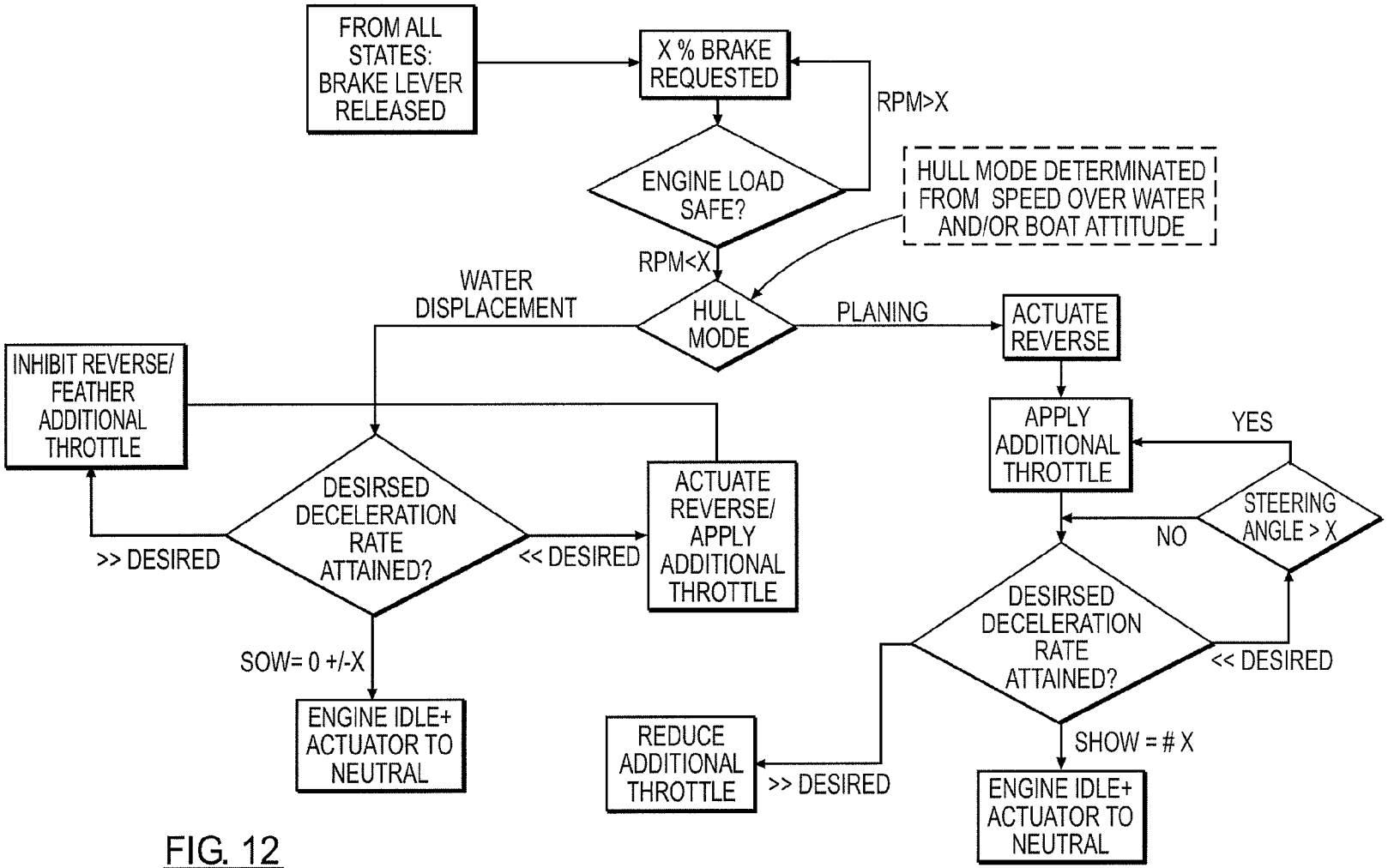
FIG. 12 is a block diagram of an example of the logic behind the braking function.

Referring to FIG. 12, a diagram showing how the control electronics processes all of these parameters is given by way of example. It will be clearly understood that the logic behind the braking function can vary from one craft to the next and that numerous other configurations could be considered without departing from the scope of the present invention.

As mentioned above, the control electronics analyses the various parameters representing the operating conditions of the watercraft and reacts accordingly. RPM sensing allows disabling the reverse actuation over a certain threshold to avoid damages to the system. Speed sensing and/or vessel's attitude sensing can be monitored to determine if actuation of the reverse gate should be disabled to avoid exceeding a maximum deceleration rate. Optionally, information from the steering angle sensor can determine that the braking function should be disabled in situations where the bow could turn in an opposite direction of the steering.

In some conditions the engine idle speed with the reverse gate lowered over the nozzle does not create enough reverse thrust to produce a sufficient deceleration rate; the control electronics can in these circumstances increase the engine RPM to generate additional reverse thrust.

Speed over Water and/or boat attitude can be used to estimate if the hull is in planing or water displacement mode.

Optionally, an embedded accelerometer can provide a means for the control electronics to know if an additional braking force is required, by comparing the actual deceleration rate vs. the desired deceleration rate, and if consequently determine if additional reverse thrust is required.

Automatic Trim System

In accordance with another aspect of the system of FIG. 1, there is provided an automatic trim system. As will be understood by one skilled in the art, the steering nozzle is vertically pivotable between a fully trimmed up and fully trimmed down positions. It can therefore be said that the steering nozzle defines a variable downward trim angle with respect to the fully trimmed up position, the trim angle being greater the closer the nozzle is to the fully trimmed down position.

The watercraft may be provided with a steering angle sensor for measuring a steering angle of the watercraft. Such sensors are well known in the art.

In the automatic trim system as described herein, the control electronics are in communication with the steering sensor for receiving the steering angle therefrom, and therefore monitoring this steering angle, preferably in a real-time continuous fashion. The control electronics then evaluates a target setting for the trim angle based on the steering angle, and optionally on operating conditions of the vehicle. The control electronics automatically issues control signals based on the evaluated target setting. An appropriate actuating device adjusts the trim angle in response to these control signals. It is to be noted that for this feature the actuation of the trim and of the reverse gate could be separate, or the reverse gate need not be present at all.

Trimming down, i.e. pointing the nozzle downward will lower the bow of the watercraft, whereas trimming up will lift the bow. A low trim generally increases acceleration by keeping the bow low and insuring that non-ventilated water reaches the pump inlet. A high trim generally provides a better top speed by reducing the contact area of the hull with water. A higher trim also generally produces a more comfortable ride as a higher bow does not dig as much into incoming waves and rides waves longer before diving.

The steering response of the watercraft is faster in low trim positions and slower at high trim. Operating a watercraft at high speed with a low trim position provides a very sharp steering response that can generate substantial lateral Gs and eject the driver or a passenger if a large and fast steering input is provided.

Trim control is also useful for heavily loaded vessel, for example when passengers or cargo are present, and when towing a tube/skier. Such situations can result in a different vessel attitude from normal conditions and require specific trim adjustments.

Figure 13A:
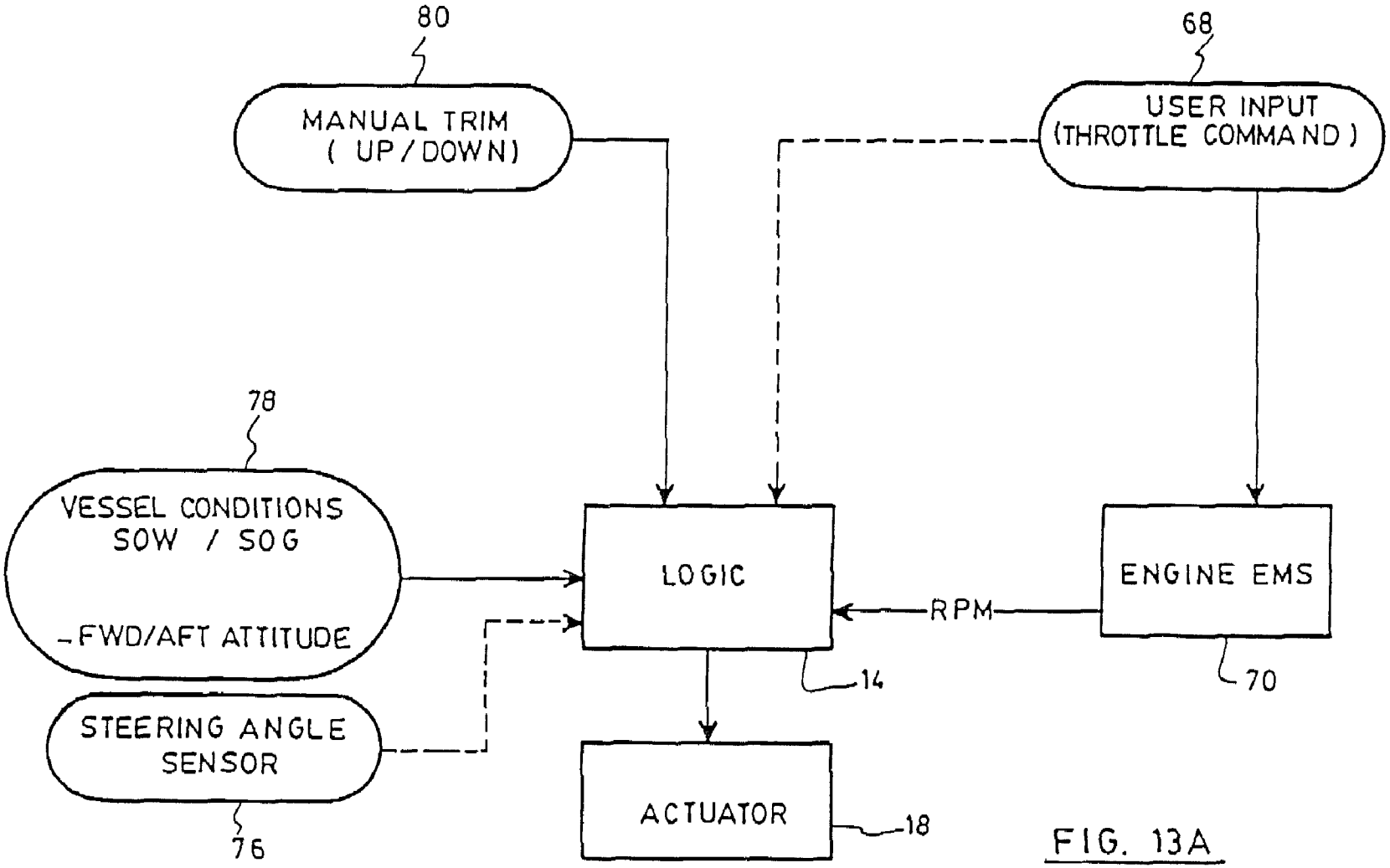
FIGS. 13A and 13B are functional diagrams illustrating automatic trim systems according to different embodiments.
Figure 13B:
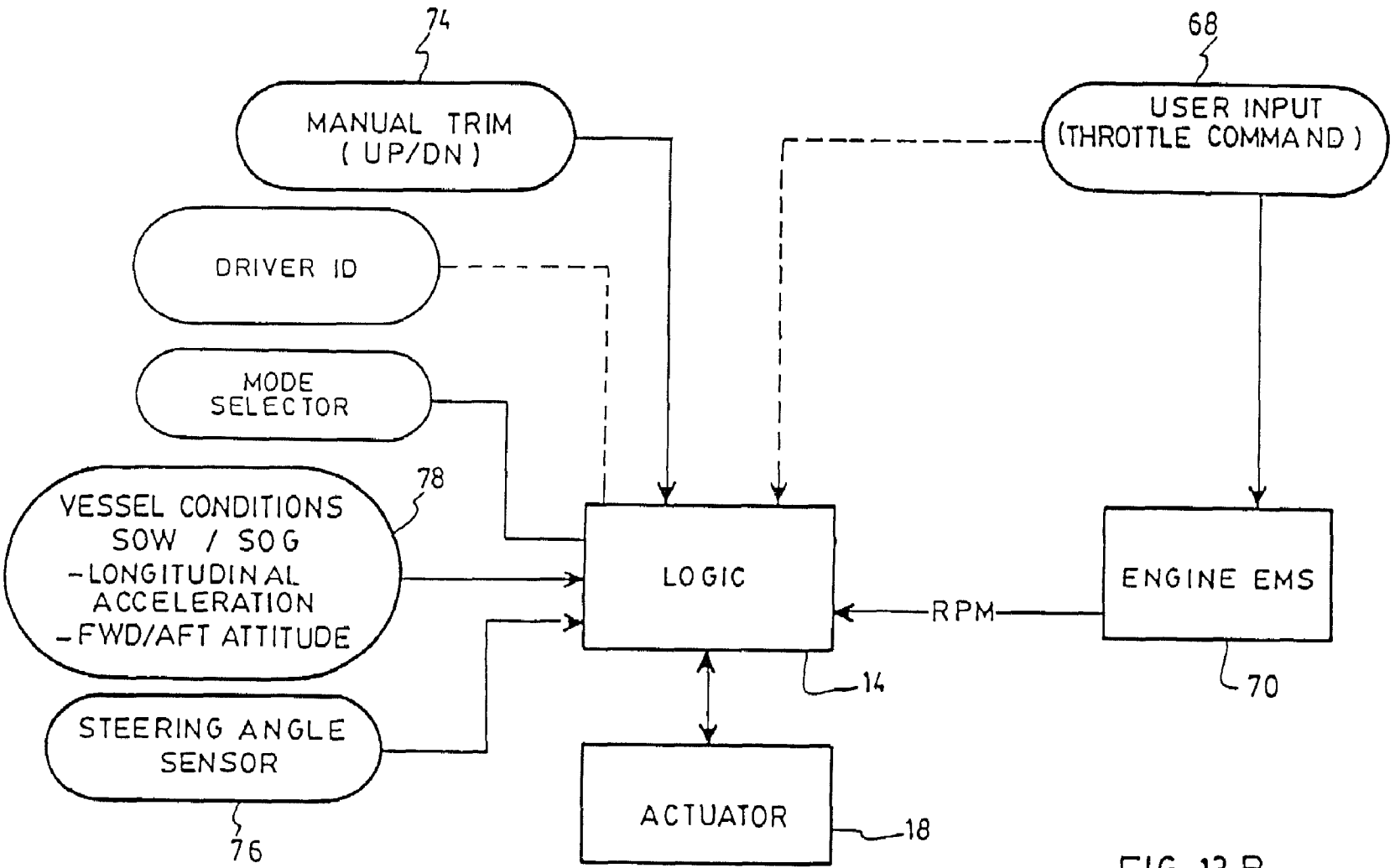

Referring to FIGS. 13A and 13B there are shown functional diagrams illustrating the use of a system according to one embodiment for managing the trim control of the watercraft. In this case, the operator interface may includes a manual trim control 80 which can be set up or down by the operator. The control electronics 14 again executes such a command taking into consideration information from at least one of the steering angle sensor 76, engine 70 and sensing devices 78.

Automatic trimming options are also provided. With respect to the steering angle, the target setting evaluated for the trim angle is preferably proportionally to steering angle, that is, the greater the turn, the lower the trim. Also preferably, during repeated left-right excursions, nozzle is fully trimmed down on full steering lock to improve steering response. In this manner, the control electronics allow the watercraft to prepare for a potential spin-off and be in optimal trim conditions for re-acceleration. The trim position may also be adjusted depending of the steering rate of change of the steering angle to improve the behaviour of the watercraft according to user-selectable modes. The control electronics 14 may include an algorithm controlling the reverse gate actuator system as a function of the data obtained from the steering angle sensor 76, and/or sensors for the vessel attitude and speed to adjust the trim angle, the position of the reverse gate or both. Such a feature may improve manoeuvrability through better turn-in abilities or improved acceleration out of a turn and prevent unwanted behaviour of the watercraft such as a too fast steering response at high speed, or under steering at lower speeds. Combined with auto attitude, this feature can improve manoeuvrability when pulling skiers or towing inflatable or other crafts. It may also be coupled with a driver identification device or system to implement learning mode or valet mode.

With respect to speed, the nozzle can be trimmed fully down at low speed to improve handling and prepare for a potential reverse command from the operator. In the preferred embodiment, since the trim and reverse functions are performed sequentially, trimming down at low speed has the advantage of the necessary reducing time to actuate the reverse gate over the nozzle. The nozzle can also be trimmed fully down to provide optimal acceleration rate when the throttle is applied. The nozzle can also be trimmed up proportionally to the speed of the watercraft to improve top speed and damp steering response.

With respect to the management from vessel's attitude, an attitude sensor can be used to correct or optimise the trim angle from a preset trim vs. speed table according to vehicle loading conditions and water conditions. Rapid changes in the vessel's forward/aft attitude can help the processor determine rough water conditions in which case the trim angle could be increased by a pre-set factor. Accelerometers, inclinometers, passenger seat weight sensors and calculated fuel weight from fuel level sensors could also be used individually or in various combinations to trim automatically the watercraft to keep the best attitude for optimal performance, fuel economy or comfort. This feature can be coupled with different mode selection, such as a sport mode, cruise mode, economy mode, tow mode, custom mode, etc. This function is intended to help keep the behaviour of the watercraft the same, with respect to the number of passenger aboard, their weight and their position, and also other vehicle parameters such as the level of fuel, accessories, cargo load and tow load (skier, craft or inflatable).

Of course, numerous modifications could be made to the embodiments described above without departing from the scope of protection.

What is claimed is:

1. A commonly actuated trim and reverse system for a jet propulsion watercraft, the watercraft including a steering nozzle vertically pivotable so as to have a variable trim angle, said watercraft further including a reverse gate pivotable so as to have a variable gate orientation, said trim and reverse system comprising:

a movable actuator operationally connected to the nozzle and the reverse gate;

a movement transfer mechanism connected to the actuator and operable to adjust the trim angle and gate orientation as a function of a movement of said actuator; and control electronics for evaluating target settings for the trim angle and gate orientation, said control electronics controlling the movement of the actuator based on said target settings for each of said trim angle and said gate orientation.

2. The trim and reverse system according to claim 1, wherein the movement transfer mechanism transfers the movement of the actuator into a movement sequence of the nozzle and of the reverse gate, said movement sequence including:

a trim segment wherein the nozzle pivots downwardly and the reverse gate remains unobtrusive of the nozzle; and an obstructing segment wherein the reverse gate is pivoted in a path of a water stream projected from said nozzle.

3. The trim and reverse system according to claim 1, wherein the movement transfer mechanism comprises:

a driving member connecting the actuator and the reverse gate for pivoting said reverse gate when said actuator moves; and a guided arrangement relating the trim angle to the gate orientation.

4. The trim and reverse system according to claim 3, wherein: the movement of the actuator is generally linear; and the driving member comprises a transfer plate translatable generally longitudinally, the transfer plate having a first end connected to the actuator and a second end connected to the reverse gate offset a pivoting axis thereof.

5. The trim and reverse system according to claim 4, wherein the guiding arrangement comprises:

a side wall projecting generally vertically from the transfer plate, said side wall being provided with a guiding slot therein; and a cam follower cooperating with said guiding slot, said cam follower being operationally connected to the pivoting of the nozzle.

6. The trim and reverse system according to claim 5, wherein the movement transfer mechanism further comprises:

a reverse gate lever having a pivot point pivotally attached to the watercraft and an upper end pivotally connected to the transfer plate;

a trim control lever having a pivot point attached to the watercraft and upper and lower ends on either side of said pivot point, the lower end being connected to the nozzle for vertically pivoting the same and the upper end being provided with said cam follower, said trim control lever being activated by the reverse gate lever.

7. The trim and reverse system according to claim 3, wherein:

the movement of the actuator is rotational;

the driving member comprises a rotatable driving shaft operatively connected to the reverse gate to pivot the same; and the guiding arrangement comprises a guiding slot provided in the reverse gate, and a cam follower cooperating with said guiding slot, said cam follower being operationally connected to the pivoting of the nozzle.

8. The trim and reverse system according to claim 1, wherein the target settings include a forward setting, a neutral setting and a reverse setting.

9. The trim and reverse system according to claim 1, wherein the target settings include at least one of a slow mode, a braking mode, and a trim control mode.

10. A jet propulsion watercraft, comprising:

a steering nozzle vertically pivotable so as to have a variable trim angle; a reverse gate pivotable so as to have a variable gate orientation; a movable actuator;

a movement transfer mechanism connected to the actuator and operable to adjust the trim angle and gate orientation as a function of a movement of said actuator; and control electronics for evaluating target settings for the trim angle and gate orientation, said control electronics controlling the movement of the actuator based on said target settings for each of said trim angle and said gate orientation.

11. The jet propulsion watercraft according to claim 10, wherein the movement transfer mechanism transfers the movement of the actuator into a movement sequence of the nozzle and of the reverse gate, said movement sequence including:

a trim segment wherein the nozzle pivots downwardly and the reverse gate remains unobtrusive of the nozzle; and a obstructing segment wherein the reverse gate is pivoted in a path of a water stream projected from said nozzle.

12. The jet propulsion watercraft according to claim 10, wherein the movement transfer mechanism comprises:

a driving member connecting the actuator and the reverse gate for pivoting said reverse gate when said actuator moves; and a guided arrangement relating the trim angle to the gate orientation.

13. The trim and reverse system according to claim 12, wherein:

the movement of the actuator is generally linear;

the driving member comprises a transfer plate translatable generally longitudinally, the transfer plate having a first end connected to the actuator and a second end connected to the reverse gate offset a pivoting axis thereof;

the guiding arrangement comprises a side wall projecting generally vertically from the transfer plate, said side wall being provided with a guiding slot therein, said guiding arrangement further comprising a cam follower cooperating with said guiding slot, said cam follower being operationally connected to the pivoting of the nozzle.

14. The trim and reverse system according to claim 12, wherein:

the movement of the actuator is rotational;

the driving member comprises a rotatable driving shaft operatively connected to the reverse gate to pivot the same; and the guiding arrangement comprises a guiding slot provided in the reverse gate, and a cam follower cooperating with said guiding slot, said cam follower being operationally connected to the pivoting of the nozzle.

15. The jet propulsion watercraft according to claim 10, further comprising an operator interface, said operator interface comprising a FNR selector in communication with the control electronics, the target settings including a forward setting, a neutral setting and a reverse setting evaluated based at least on a state of the FNR selector.

16. The jet propulsion watercraft according to claim 10, further comprising an operator interface, said operator interface comprising a brake lever in communication with the control electronics, the target settings including a braking setting evaluated based at least on a state of the brake lever.

17. A trim and reverse system for a jet propulsion watercraft, the watercraft including a steering nozzle vertically pivotable so as to have a variable trim angle, said watercraft further including a reverse gate pivotable so as to have a variable gate orientation, said trim and reverse system comprising:

a movable actuator operationally connected to the nozzle and the reverse gate so the trim angle and gate orientation are adjusted as a function of a movement of said actuator; and control electronics for evaluating target settings for the trim angle and gate orientation, said control electronics controlling the movement of the actuator based on said target settings for each of said trim angle and said gate orientation.

18. The trim and reverse system according to claim 17, wherein the target settings include a forward setting, a neutral setting and a reverse setting.

19. The trim and reverse system according to claim 17, wherein the target settings include at least one of a slow mode, a braking mode, and a trim control mode.

* * * * *